US008422900B2

(12) United States Patent
Aoki et al.

(10) Patent No.: US 8,422,900 B2
(45) Date of Patent: Apr. 16, 2013

(54) APPARATUS AND METHOD OF CONTROLLING AN IMAGE FORMING APPARATUS

(75) Inventors: Shinji Aoki, Yokohama (JP); Fumihito Masubuchi, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 431 days.

(21) Appl. No.: 12/776,712

(22) Filed: May 10, 2010

(65) Prior Publication Data

US 2010/0284705 A1 Nov. 11, 2010

(30) Foreign Application Priority Data

May 8, 2009 (JP) ..... 2009-113929

(51) Int. Cl.
*G03G 15/16* (2006.01)
*G03G 15/01* (2006.01)
*G03G 15/20* (2006.01)

(52) U.S. Cl.
USPC ..... 399/66; 399/40; 399/314

(58) Field of Classification Search ..... 399/40, 399/66, 314
See application file for complete search history.

(56) References Cited

U.S. PATENT DOCUMENTS

| | | | | |
|---|---|---|---|---|
| 6,658,220 | B2 * | 12/2003 | Bessho et al. | 399/44 |
| 2004/0161262 | A1 * | 8/2004 | Uyama et al. | 399/149 |
| 2009/0123168 | A1 | 5/2009 | Aoki et al. | |

FOREIGN PATENT DOCUMENTS

| | | |
|---|---|---|
| JP | 6-289682 | 10/1994 |
| JP | 8-54771 | 2/1996 |
| JP | 2586217 | 12/1996 |
| JP | 2003-186284 | 7/2003 |
| JP | 2005-338636 | 12/2005 |

OTHER PUBLICATIONS

U.S. Appl. No. 12/723,050, filed Mar. 12, 2010, USAMI, et al.

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

An image forming apparatus is provided with a controller that determines whether a first toner image to be firstly transferred to a transfer body has a portion that is not superimposed by a second toner image to be subsequently transferred to the transfer body so as to be superimposed on the first toner image to generate a determination result, and controls a transfer bias supplied to a transfer device that causes the second toner image to be transferred to the transfer body and an amount of toner to be adhered to form the second toner image, respectively, based on the determination result.

13 Claims, 6 Drawing Sheets

FIG. 6A
FIG. 6B
FIG. 6C
FIG. 6D
FIG. 6E
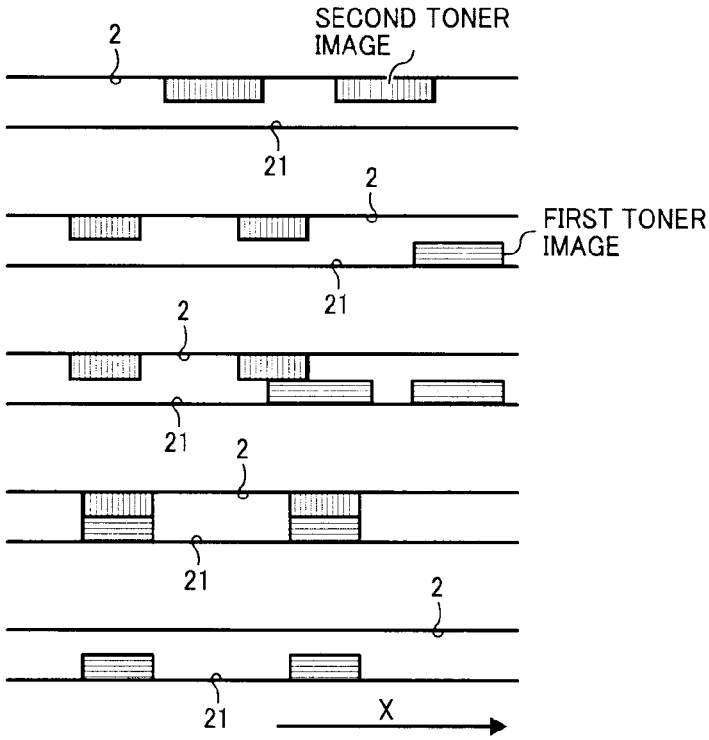
FIG. 7
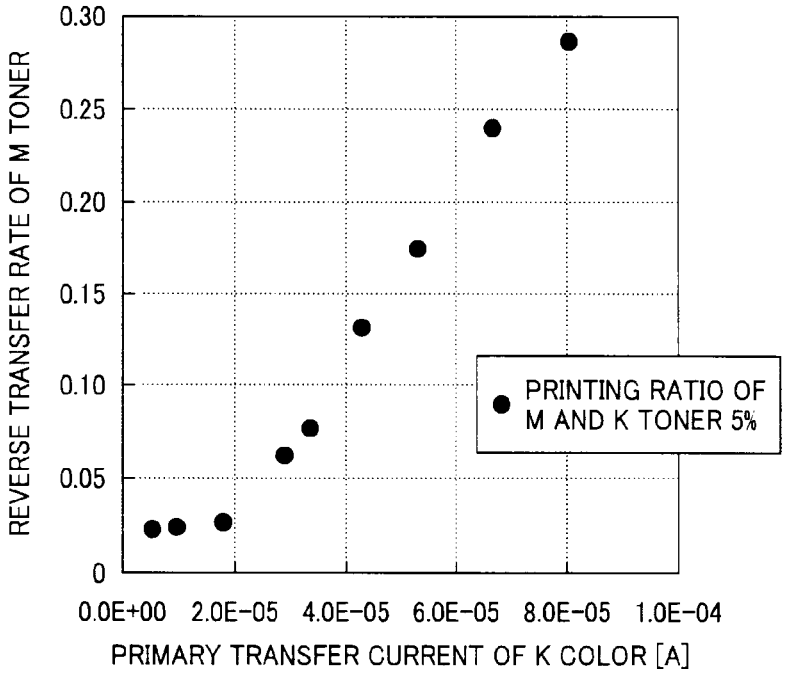

APPARATUS AND METHOD OF CONTROLLING AN IMAGE FORMING APPARATUS

CROSS-REFERENCE TO RELATED APPLICATIONS

This patent application is based on and claims priority under 35 U.S.C. §119 to Japanese Patent Application No. 2009-113929, filed on May 8, 2009, in the Japanese Patent Office, the entire disclosure of which is hereby incorporated herein by reference.

FIELD OF THE INVENTION

The present invention generally relates to an image forming apparatus, and more specifically to an apparatus and a method of controlling an image forming apparatus capable of forming a color image.

BACKGROUND

A tandem-type image forming apparatus forms a color composite toner image on a transfer body by superimposing toner images of respective colors one above the other. More specifically, after a first toner image formed on an image carrier is transferred to the transfer body, a second toner image formed on the image carrier is transferred from the image carrier onto the transfer body having the first toner image that is previously transferred, such that the second toner image is superimposed on the first toner image over its entire area.

Due to the resistivity of toner of the first toner image, a transfer current tends to flow through a section other than the section at which the second toner image is superimposed over the first toner image. Accordingly, the section at which the second toner image is superimposed on the first toner image is not provided with a sufficient level of transfer current, thus lowering a toner transfer rate. The toner transfer rate refers to the amount of second toner image that is actually superimposed on the first toner image with respect to the total amount of second toner image formed on the image carrier. The lowered transfer rate causes a decrease in image density as the amount of toner that is transferred to the transfer body decreases, which is undesirable.

Japanese Patent Application Publication No. 2003-186284 discloses an image forming apparatus, which obtains a ratio indicating the degree of overlap between the second toner image and the first toner image, and determines a transfer current based on the obtained ratio.

While the technique disclosed in Japanese Patent Application Publication No. 2003-186284 should be able to suppress degradation in image quality as the transfer rate increases, a portion of the first toner image that is not superimposed by the second toner image may be transferred from the transfer body back to the image carrier. This phenomenon, called reverse transfer, reduces the amount of toner in the first toner image, thus causing degradation in image quality.

If the image forming apparatus implements the cleanerless method as described in any one of Japanese Patent Application Publication Nos. H05-313431, H08-54771, and 2005-338636, toner having a specific color that is reverse-transferred to the image carrier may be collected by a developing device to be mixed with toner of the other color. Unless a toner bottle is replaced with a new one, the color reproducibility of the image forming apparatus stays at a low level due to mixing of toner of different colors.

SUMMARY

The inventors of the present invention have discovered one of the factors that causes reverse transfer of toner in a portion of the first toner image that is not superimposed by the second toner image. The portion of the first toner image that is not superimposed by the second toner image is made to come into contact with the non-image section of the image carrier having no image formed thereon. Since the non-image section has a potential higher than that of the image section of the image carrier having the image formed thereon, the potential difference between the non-image section of the image carrier and the transfer body becomes larger than the potential difference between the image section of the image carrier and the transfer body. Accordingly, the transfer current tends to flow between the non-image section of the image carrier and the transfer body, rather than between the image section of the image carrier and the transfer body. More specifically, the transfer current tends to flow through the portion of the first toner image that is not superimposed by the second toner image, rather than through the portion of the first toner image that is superimposed by the second toner image. This causes toner in the portion of the first toner image that is not superimposed by the second toner image to have a polarity opposite to the expected charging polarity. Due to this reversed polarity of toner, the portion of the first toner image that is not superimposed by the second toner image is transferred back to the image carrier.

Further, the inventors of the present invention have discovered that the problem of reverse transfer or toner mix may occur in any desired image forming apparatus other than the tandem-type image forming apparatus including, for example, a one-drum type image forming apparatus.

In view of the above, an aspect of the present invention is to provide an apparatus and method of controlling a full-color image forming apparatus in a manner to suppress the occurrence of reverse transfer.

Another aspect of the present invention is to provide an apparatus and method of controlling a full-color image forming apparatus in a manner to suppress mixing of toner of different colors.

In order to suppress the occurrence of reverse transfer or mixing of toner of different colors, the image forming apparatus is provided with a controller that determines whether a first toner image to be firstly transferred to a transfer body has a portion that is not superimposed by a second toner image to be subsequently transferred to the transfer body so as to be superimposed on the first toner image to generate a determination result, and controls a transfer bias applied to a transfer device that causes the second toner image to be transferred to the transfer body and an amount of toner to be adhered to form the second toner image, respectively, based on the determination result.

In addition to the above-described example embodiments, the present invention may be practiced in various other ways.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 6A to 6E are an illustration for explaining the degree of overlap between a first toner image previously transferred to the intermediate transfer belt of the image forming apparatus of FIG. 1 and a second toner image to be transferred to the intermediate transfer belt of the image forming apparatus of FIG. 1;

FIG. 7 is a graph illustrating the relationship between a reverse transfer rate and a primary transfer current;

Figure 1:
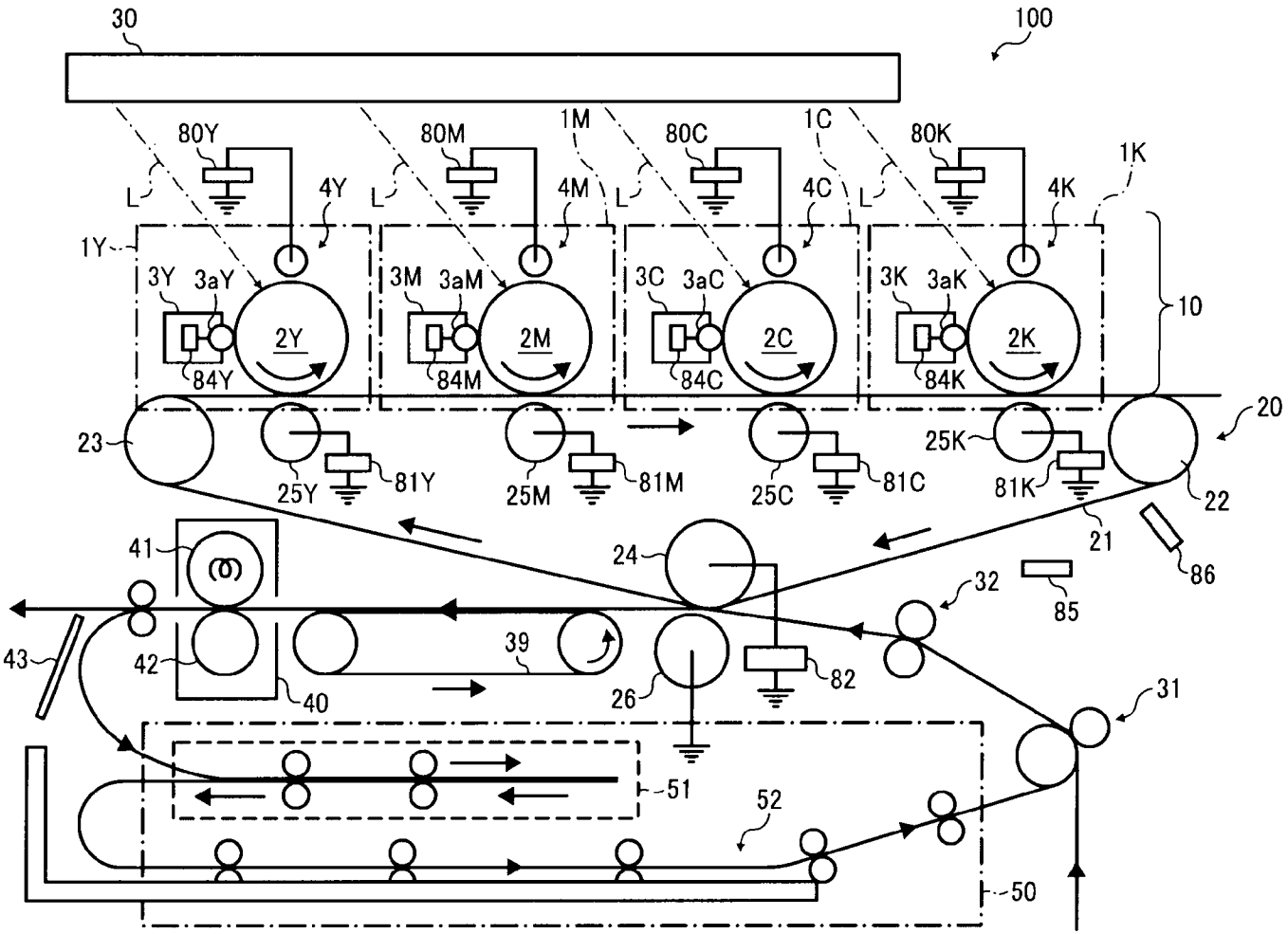
FIG. 1 is a cross-sectional diagram illustrating a selected portion of an image forming apparatus of an intermediate transfer tandem type according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to FIG. 1, a structure of an image forming apparatus 100 is explained according to an example embodiment of the present invention. The image forming apparatus 100 is implemented by a color printer, which forms a color toner image using a tandem-type image forming device. For the descriptive purpose, in this example, the image forming apparatus 100 may be referred to as a printer 100. Alternatively, the image forming apparatus 100 may be implemented by, for example, any desired type of image forming apparatus capable of forming an image such as a printer, a copier, a facsimile, etc.

The printer 100 mainly includes an optical writing unit 30 capable of forming a latent image, a tandem-type image forming device 10, a transfer device 20, a fixing device 40, and a re-feeding device 50. The tandem-type image forming device 10, which may be referred to as the image forming device 10, includes four image forming units 1Y, 1M, 1C, and 1K that respectively form a yellow (Y) color image, magenta (M) color image, cyan (C) color image, and black (K) color image.

The transfer device 20 mainly includes an intermediate transfer belt 21, a drive roller 22, a driven roller 23, a first secondary transfer roller 24, a second secondary transfer roller 26, and four primary transfer rollers 25Y, 25M, 25C, and 25K. The intermediate transfer belt 21, which is an endless belt, functions as a transfer body to which the toner images are transferred from the image forming device 10. The intermediate transfer belt 21 is wound around the drive roller 22, the driven roller 23, and the first secondary transfer roller 24 so as to form the reversed triangle shape when viewed from the side of the printer 100. The intermediate transfer belt 21 is made of carbon distributed polyimide, and has a thickness of 60 μm, the volume resistivity of about 1E9 Ωcm (measured at the applied voltage of 100 V using a resistivity meter, Hiresta-UP, MCP-HT450, manufactured by Mitsubishi Chemical Analytech Co., Ltd.), and the tensile elasticity of 2.6 GPa. The intermediate transfer belt 21 is rotatably driven by the drive roller 22, which is driven by a drive source, in the clockwise direction as indicated by the arrows shown in FIG. 1. In the inside of a loop formed by the intermediate transfer belt 21, four primary transfer rollers 25Y, 25M, 25C, and 25K are provided in addition to the drive roller 22, the driven roller 23, and the first secondary transfer roller 24.

In the image forming device 10, four image forming units 1Y, 1M, 1C, and 1K (collectively referred to as the image forming unit 1) are arranged above the transfer device 20 in this order in the belt transfer direction along the outer surface of the intermediate transfer belt 21. The image forming units 1Y, 1M, 1C, and 1K respectively include photoconductors 2Y, 2M, 2C, and 2K (collectively referred to as the photoconductor 2) each having the drum-like shape, developing units 3Y, 3M, 3C, and 3K (collectively referred to as the developing unit 3), and charging units 4Y, 4M, 4C, and 4K (collectively referred to as the charging unit 4). The photoconductors 2Y, 2M, 2C, and 2K each rotate in the counterclockwise direction as indicated by the arrows in FIG. 1. The photoconductors 2Y, 2M, 2C, and 2K are made in close contact with the outer surface of the intermediate transfer belt 21 to form primary transfer nips respectively for the image forming units 1Y, 1M, 1C, and 1K. The photoconductors 2Y, 2M, 2C, and 2K are respectively rotated by corresponding drive sources in the counterclockwise direction. The photoconductors 2Y, 2M, 2C, and 2K are each formed of organic photoconductive body provided with a photoconductive layer having an elastic capacity of about 9.5E-7 F/$m^2$. The charging units 4Y, 4M, 4C, and 4K are respectively applied with an electric charge bias by charger power sources 80Y, 80M, 80C, and 80K so as to cause the surface of the photoconductors 2Y, 2M, 2C, and 2K to be uniformly charged with the same polarity as the toner charging polarity.

The developing units 3Y, 3M, 3C, and 3K each store therein toner made of polyether material and magnetic carrier, and respectively provided with developing rollers 3*a*Y, 3*a*M, 3*a*C, and 3*a*K (collectively referred to as the developing roller 3*a*). The developing rollers 3*a*Y, 3*a*M, 3*a*C, and 3*a*K, each capable of carrying a developing agent, are rotated in the clockwise direction by a drive motor. With the rotation, the developing rollers 3*a*Y, 3*a*M, 3*a*C, and 3*a*K transfer a predetermined amount of developer agent that are accumulated on the surface of the developing rollers 3*a* to the respective developing areas, which are the respective positions of the surface of the developing rollers 3*a* that face the photoconductors 2Y, 2M, 2C, and 2K. The developing rollers 3*a*Y, 3*a*M, 3*a*C, and 3*a*K are each provided therein a plurality of magnets at the portions that face the respective developing areas provided for the developing units 3Y, 3M, 3C, and 3K. The developer agent carried by the developing rollers 3*a*Y, 3*a*M, 3*a*C, and 3*a*K on their surfaces stand up at the respective developing areas by magnetic force applied by the magnets, thus forming the magnetic brushes on the developing roller surfaces which are made in contact with the photoconductors 2Y, 2M, 2C, and 2K. The developing rollers 3*a*Y, 3*a*M, 3*a*C, and 3*a*K are respectively applied with a developing bias by developer power sources 84Y, 84M, 84C, and 84K (collectively referred to as "the developer power source 84"). Due to the developing bias that is applied and the latent image electric field generated by the electrostatic latent image formed on the photoconductor 2, the toner is transferred from the standing developing agents on the developing rollers 3*a*Y, 3*a*M, 3*a*C, and 3*a*K to the photoconductor surfaces of the photoconductors 2Y, 2M, 2C, and 2K to develop the latent images formed on the photoconductor surfaces into toner images.

Still referring to FIG. 1, at the primary transfer nips provided for the image forming units 1Y, 1M, 1C, and 1K, the primary transfer rollers 25Y, 25M, 25C, and 25K press the intermediate transfer belt 21 against the photoconductors 2Y, 2M, 2C, and 2K. The primary transfer rollers 25Y, 25M, 25C, and 25K are each made of a metal core covered by an elastic body such as sponge. The volume resistivity, except for the core metal, of each of the primary transfer rollers 25Y, 25M, 25C, and 25K is about 1E9 Ωcm. The primary transfer rollers 25Y, 25M, 25C, and 25K are respectively applied by primary transfer power sources 81Y, 81M, 81C, and 81K (collectively referred to as "the primary transfer power source 81") with a primary transfer current having a polarity opposite from the toner electric charge polarity. Under control of the printer 100, the primary transfer power source 81 applies the primary transfer current having a predetermined value.

The optical writing unit 30 is provided above the image forming device 10. The optical writing unit 30 irradiates scanning light L to respectively form electrostatic latent images onto the surfaces of the photoconductors 2Y, 2M, 2C, and 2K, each of which are uniformly changed by the charging units 4Y, 4M, 4C, and 4K at −650 V. The electric potential VI for the electrostatic latent image for forming a black solid image is about −100 V. The developing units 3Y, 3M, 3C, and 3K develop the electrostatic latent images formed on the photoconductors 2Y, 2M, 2C, and 2K with the toner having the negative polarity of about −20 μc/g to form the toner images of Y, M, C, and K. The amount of toner applied for the developing process is about 0.6 mg/cm$^2$ for the black solid image. The toner images of Y, M, C, and K are respectively transferred to the surface of the intermediate transfer belt 21 at the primary transfer nips for the image forming units 1Y, 1M, 1C, and 1K. As the intermediate transfer belt 21 moves, the toner images of Y, M, C, and K are superimposed one above the other to form a full-color composite toner image.

In this example, in order to uniformly charge the surfaces of the photoconductors 2Y, 2M, 2C, and 2K, the charging units 4Y, 4M, 4C, and 4K are respectively provided. The electric discharge are generated respectively between the charging units 4Y, 4M, 4C, and 4K and the photoconductors 2Y, 2M, 2C, and 2K while keeping the charging units 4Y, 4M, 4C, and 4K to which the charging bias are applied by the charger power sources 80Y, 80M, 80C, and 80K at positions close, but not in contact, to the photoconductors 2Y, 2M, 2C, and 2K. In alternative to the charging units 4Y, 4M, 4C, and 4K described above, a charging device of scorotron type may be provided.

The transfer device 20 further includes the second secondary transfer roller 26 provided at a position below the intermediate transfer belt 21. The second secondary transfer roller 26 forms a secondary transfer nip by causing the outer surface of the intermediate transfer belt 21 to be in contact with a position of the intermediate transfer belt 21 where the intermediate transfer belt 21 is wound around the first secondary transfer roller 24. In this example, the second secondary transfer roller 26 is a roller made of a metal core covered by an elastic body such as urethane. The volume resistivity of the second secondary transfer roller 26 except for the core metal is about 1E9 Ωcm. The first secondary transfer roller 24 is a roller made of a metal core covered by an elastic body such as urethane. The volume resistivity of the secondary transfer roller 26 except for the core metal is about 1E9 Ωcm. The transfer device 20 is additionally provided with a secondary transfer bias power source 82. The secondary transfer bias power source 82 applies a secondary transfer bias having a polarity that is the same with a charging polarity of toner to the first secondary transfer roller 24. At the secondary transfer nip formed between the first secondary transfer roller 24 and the second secondary transfer roller 26, a secondary transfer electric field is formed to transfer toner from the portion of the intermediate transfer belt 21 at which the first secondary transfer roller 24 is provided to a recording sheet transferred above the second secondary transfer roller 26.

The recording sheet is transferred to the secondary transfer nip at a predetermined timing. The full-color composite toner image formed on the intermediate transfer belt 21 is transferred onto the recording sheet by the nip pressure and the secondary transfer electric field generated at the secondary transfer nip.

The residual toner that remains the surface of the intermediate transfer belt 21 after passing the secondary transfer nip is removed by a belt cleaning device that may be provided downstream of the secondary transfer nip in the belt transfer direction.

The recording sheet having the full-color composite toner image formed thereon is carried by the surface of a sheet transfer belt 39, which is rotated in the counterclockwise direction as indicated by the arrow in FIG. 1, to the fixing device 40. At the fixing device 40, the recording sheet is transferred through a fixing nip, which is formed by a heating and fixing roller 41 and a pressure roller 42 that are made in close contact with each other. The heating and fixing roller 41 includes a heating source such as a halogen lamp therein, and is set at a fixing temperature of 160 degrees Celsius. The pressure roller 42 is pressed against the heating and fixing roller 41. With the heat and pressure, the toner image formed on the recording sheet is fixed to the recording sheet. The recording sheet having the toner image fixed thereon is discharged through a discharge roller pair to the outside of the printer 100. In alternative to being transferred to the discharge roller pair, the recording sheet output from the fixing device 40 may be transferred back to the re-feeding device 50.

More specifically, in case of performing a printing job in a single-sided printing mode which forms an image on only the first side of the recording sheet, the recording sheet output by the fixing device 40 is transferred to the discharge roller pair. In case of performing a printing job in a double-sided printing mode which forms images on the both sides of the recording sheet, the recording sheet output by the fixing device 40 is sent to the re-feeding device 50 when the recording sheet has the image formed only on the first side. When the recording sheet has the images formed on both sides of the recording sheet, the recording sheet output by the fixing device 40 is transferred to the discharge roller pair. The printer 100 of FIG. 1 is provided with a switch pawl 43 to switch between a path that leads the recording sheet to the discharge roller pair and a path that leads the recording sheet to the re-feeding device 50.

The re-feeding device 50 includes a switch back device 51, which switches back the recording sheet that is sent from the fixing device 40 to reverse the side of the recording sheet, and transfers the recording sheet to a switch back path 52. The recording sheet after passing the switch back path 52 is transferred to a transfer path, which is a part of a transfer path provided for feeding the recording sheet from a sheet feeding cassette to the secondary transfer nip. In this manner, the recording sheet having the side being reversed is transferred to the secondary transfer nip.

More specifically, in this example, the recording sheet transferred from the re-feeding device 50 passes a transfer roller pair 31 and a registration roller pair 32 before reaching the secondary transfer nip. In this example, the registration roller pair 32 is made of stainless. The re-feeding device 50 transfers the recording sheet to a position upstream of the transfer roller pair 31 in the sheet feeding direction. The recording sheet, which may be directly fed from the sheet feeding cassette or re-sent from the re-feeding device 50, is caused to pass the transfer roller pair 31 and the registration roller pair 32 in the sheet feeding path.

When the registration roller pair 32 stops its rotation, the registration roller pair 32 is made in contact with the leading edge of the recording sheet to correct the skew of the recording sheet. Immediately after the registration roller pair 32 is rotated to allow the leading edge of the recording sheet to transfer through a registration nip formed by the registration roller pair 32, the rotation of the registration roller pair 32 is stopped. The registration roller pair 32 starts rotating at a timing such that the recording sheet will receive the toner image formed on the intermediate transfer belt 21 at the secondary transfer nip.

In this example, the linear speed for processing the printer 100 is set about 280 mm/s. Further, in this example, the printer 100 is additionally provided with an optical sensor 86 and a temperature/humidity sensor 85, at the positions apart from the outer surface of the intermediate transfer belt 21 by a predetermined distance.

In this example, the image forming units 1Y, 1M, 1C, and 1K each implement the cleaner-less method. The cleaner-less method allows the residual toner, which remains the surfaces of the photoconductors 2Y, 2M, 2C, and 2K after the toner images are transferred to the intermediate transfer belt 21, to be recycled without requiring a cleaning device. If the cleaner-less method is not implemented, the image forming unit 10 is generally provided with a cleaning device that removes the residual toner from the photoconductor surface and transfers the collected toner to a toner discharge device or the developing unit 3. In the cleaner-less method, the residual toner that remains the photoconductor surface is charged with a negative polarity as the residual toner passes an area opposing the charging unit 4. At a developing area where the developing roller 3*a* and the photoconductors 2 face with each other, the residual toner that remains on the photoconductor surface is transferred to the developing roller 3*a*. This causes the residual toner to be collected into the developing unit 3.

Further, in order to reduce an attraction force formed between the residual toner and the photoconductor surface, a removing member such as a brush may be provided at a position between the transfer area at which the toner image is transferred to the intermediate transfer belt 21 and the developing area of the photoconductor surface to scratch the residual toner that remains on the photoconductor 2. Additionally, a collecting member may be provided, which temporarily holds the residual toner transferred by the photoconductor surface as the photoconductor 2 rotates. For example, the collecting member may be implemented by a rotatable brush member that rotates while causing its surface to be in contact with the photoconductor surface. At a predetermined timing such as the time when the printing job completes or the time when a next recording sheet is fed, the residual toner kept by the collecting member is transferred back to the photoconductor 2. The toner is then transferred to the developing roller 3*a* to be accumulated in the developing unit 3. The structure and function for implementing the cleaner-less method is not limited to the above-described examples such that any desired structure and function may be used to implement the cleaner-less method.

Figure 2:
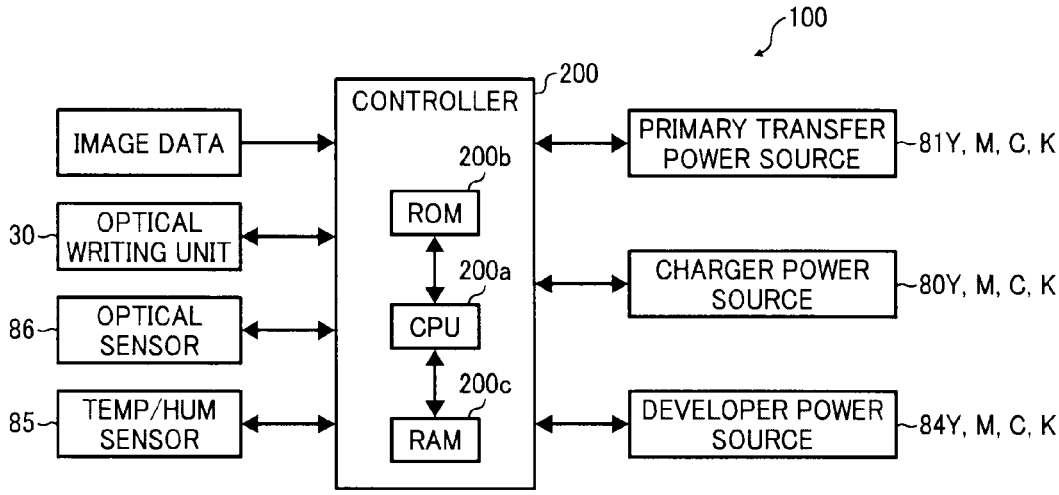
FIG. 2 is a schematic block diagram illustrating a structure of a selected portion of an electric circuit of the image forming apparatus of FIG. 1.

The printer 100 of FIG. 1 is provided with a controller 200 as illustrated in FIG. 2. Referring to FIG. 2, the controller 200 includes a central processing unit (CPU) 200*a*, a read only memory (ROM) 200*b*, and a random access memory (RAM) 200*c*. The CPU 200*a* may be implemented by any desired processor. The ROM 200*b* is a volatile memory that stores various data such as a program for controlling operation of the printer 100. The RAM 200*c* is a non-volatile memory storing various data to be used by the CPU 200*a* to control operation of the printer 100. The controller 200 controls entire operation of the printer 100, and connected to various devices or sensors in the printer 100. For the descriptive purpose, FIG. 2 illustrates a selected portion of devices and sensors controlled by the controller 200. The controller 200 performs various functions according to a control program stored in any desired memory such as the RAM 200*c* or the ROM 200*b*.

In one example, the controller 200 calculates a printing ratio of the image for each color of Y, M, C, and K based on image information such as the image data. The controller 200 determines whether the first toner image previously transferred to the intermediate transfer belt 21 will be superimposed entirely by the second toner image to be transferred to the intermediate transfer belt 21, based on image information such as the image data, to generate an overlap degree determination result. Further, the controller 200 calculates the values of primary transfer current respectively for the image forming units 1Y, 1M, 1C, and 1K based on the printing ratio that is calculated or the overlap degree determination result. The controller 200 controls the primary transfer power source 81 so as to generate a primary transfer current having a value calculated based on the printing ratio or the overlap degree determination result.

Further, the controller 200 controls the developing bias for each color based on the overlap degree determination result to control the amount of toner to be adhered to the transfer body such as the intermediate transfer belt 21 to form the second toner image on the transfer body. The amount of toner adhered to the transfer body for forming the second toner image may be increased or decreased by increasing or decreasing the potential difference between the developing unit 3 and the photoconductor surface. For example, the controller 200 controls the developer power source 84 so as to generate a developing bias having a value calculated based on the overlap degree determination result. In another example, the controller 200 controls the charger power source 80 so as to generate a charge potential having a value obtained based on the overlap degree determination result.

Figure 3:
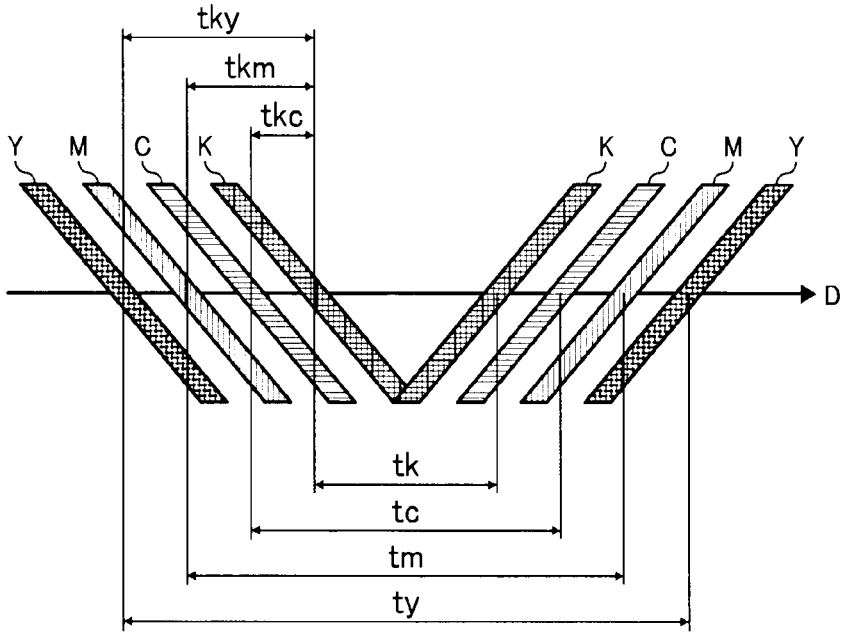
FIG. 3 is an illustration for explaining a Cevron patch formed on an intermediate transfer belt of the image forming apparatus of FIG. 1.

Further, in this example, the controller 200 performs operation of correcting the positional displacement at a predetermined time, for example, when a power switch of the printer 100 is turned on or when performing operation of printing for a predetermined number of times. More specifically, in order to correct the positional displacement, the controller 200 causes the printer 100 to form a plurality of toner images to be used for positional displacement detection as illustrated in FIG. 3, which may be referred to as a Chevron patch PV. Using the optical sensor 86, the controller 200 detects the positional displacement from the Chevron patch PV.

In this example, the optical sensor 86 is provided with a light source, a collective lens, a light receiving element, etc. The light irradiated by the light source of the optical sensor 86 passes through the collective lens to reach the surface of the intermediate transfer belt 21 to generate a reflected light reflected by the surface of the intermediate transfer belt 21. The optical sensor 86 outputs a voltage having a level determined by the level of the reflected light received by the light receiving element. When the toner images of the Chevron patch PV formed on the intermediate transfer belt 21 pass the optical sensor 86, the level of the light received by the light receiving element of the optical sensor 86 greatly changes. Based on the light level detected by the optical sensor 86, the controller 200 is able to detect the toner images of the Chevron patch PV formed on the intermediate transfer belt 21 as they pass the optical sensor 86. In this example, the light source of the optical sensor 86 may be implemented by a light emitting diode (LED) capable of outputting the light having a level that is sufficient for the toner image to be detected. The light receiving element of the optical sensor 86 may be implemented by, for example, a charged coupled device (CCD) having a plurality of light receiving elements that are arranged in line.

Based on the detected toner images of the Chevron patch PV, the controller 200 determines the position of each toner image of the Chevron patch PV in the sub-scanning direction, which is the belt transfer direction D. As illustrated in FIG. 3, the Chevron patch PV is made of a group of line patterns of Y, M, C, and K color toner images, which are arranged at a predetermined pitch in the sub-scanning or belt transferring direction D. Each toner image is tilted by about 45 degrees with respect to the main scanning direction X. The main scanning direction X is the direction in which the laser light beam L is scanned through the photoconductor surface, and is perpendicular to the sub-scanning direction D. At a left side shown in FIG. 3, the Y, M, C, and K toner images are arranged from left to right in the belt transfer direction D indicated by the arrow in FIG. 3. At a right side shown in FIG. 3, the other K, C, M, and Y toner images, which can be obtained by rotating the K, C, M, and Y toner images that are arranged at the left side by 90 degrees, are arranged.

For each one of the Y, M, and C color toner images, a calculated value and a predetermined value of the time differences tky, tkm, and tkc are obtained. More specifically, the controller 200 obtains a calculated time difference tky between a time tk at which the K toner image is detected and a time ty at which the Y toner image is detected, a calculated time difference tkm between the time tk at which the K toner image is detected and a time tm at which the M toner image is detected, and a calculated time difference tkc between the time tk at which the K toner image is detected and a time tc at which the C toner image is detected. The predetermined value of the time differences tky, tkm, and tkc may be previously stored in a memory, such as the RAM 200*c* of the controller 200. Based on the difference between the calculated value and the predetermined value of the time difference, the positional displacement for the toner image of each color in the sub-scanning direction D is obtained. Based on the positional displacement, the controller 200 corrects the timing for starting image writing operation of the optical writing unit 30 with respect to the photoconductor 2, thus suppressing the positional displacement of each toner image attributable to the fluctuations in rotational speed of the photoconductor 2 and the intermediate transfer belt 21.

In alternative to the above-described example, the controller 200 may perform operation of correcting the positional displacement in various other ways.

Referring now to FIGS. 1 and 2, operation of controlling the primary transfer current and the developing bias for the respective colors is explained.

First, operation of controlling the primary transfer current I1 and the developing bias Vb1 of the image forming unit 1Y, which is provided most upstream in the belt transfer direction D of the intermediate transfer belt 21, is explained. The controller 200 controls the primary transfer current I1 for the Y color, pixel by pixel in the sub-scanning direction, i.e., the belt transfer direction D of the intermediate transfer belt 21, based on the printing ratio η1 of the Y toner image.

Figure 4:
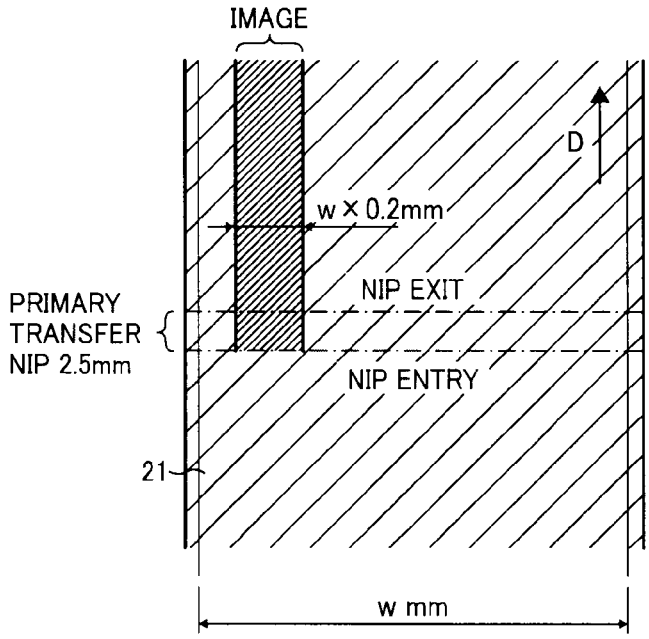
FIG. 4 is an illustration for explaining a printing ratio of an image formed or to be formed on the intermediate transfer belt of the image forming apparatus of FIG. 1.

In one example, as illustrated in FIG. 4, the controller 200 obtains the printing ratio η1 of the Y toner image in the main scanning direction X perpendicular to the belt transfer direction D, which is detected or to be formed on the intermediate transfer belt 21 at an exit of the primary transfer nip ("nip exit" in FIG. 4). In this example, a distance between a nip entry of the primary transfer nip and the nip exit of the primary transfer nip is about 2.5 mm in the belt transfer direction D. When the intermediate transfer belt 21 and the photoconductor 2Y respectively move by one pixel in the sub-scanning direction D, the printing ratio of the Y toner image at the nip exit changes. This causes the primary transfer current that flows through the primary transfer roller 25Y to change to a value corresponding to the changed printing ratio value. For this reason, the primary transfer current is controlled based on the printing ratio detected or to be formed at the nip exit. When toner of the toner image formed on the photoconductor 2Y is transferred from the photoconductor 2Y to the intermediate transfer belt 21, the primary transfer current flows between the photoconductor 2Y and the intermediate transfer belt 21. The primary transfer current applied to the primary transfer roller 25Y flows through the nip exit of the primary transfer nip at which toner is transferred from the photoconductor 2Y to the intermediate transfer belt 21. The primary transfer current applied to the primary transfer roller 25Y is mainly used for transferring of toner at the nip exit. In order to keep a transfer rate at a sufficiently high level, the controller 200 controls the primary transfer current to be applied to the primary transfer nip based on the printing ratio of the toner image detected or to be formed at the nip exit.

Still referring to FIG. 4, the printing ratio η is explained. The printing ratio indicates a ratio of a section where printing is performed to a section where printing can be performed. For example, the printing ratio η may be obtained as a value indicating the ratio of the width of a toner image formed on the intermediate transfer belt 21 with respect to the width W of an image forming area of the intermediate transfer belt 21 in the main scanning direction X. For example, the solid image pattern illustrated in FIG. 4 shown as a rectangular shape pattern has a width in the main scanning direction X that is equal to W*0.2 mm, with W indicating the width of the image forming area of the intermediate transfer belt 21. This indicates that the toner image formed on the intermediate transfer belt 21 has the width, which is 20 percent of the width W of the image forming area of the intermediate transfer belt 21. Accordingly, the solid image pattern of FIG. 4 is formed with a printing ratio of 20 percent. The printing ratio may be calculated by the controller 200 based on image data such as an image input signal obtained from an image data input device such as a computer or a scanner connected to the printer 100, or a laser writing signal generated by the optical writing unit 30 when forming a latent image on the photoconductor 2.

Based on the printing ratio, the controller 200 determines the value of a primary transfer current for the image forming unit 1Y. The primary transfer current I1 for the Y color is expressed as follows when the toner charge level is −20 μC/g. In the following equations, the printing ratio η1 is a value between 0 and 1.

When there is a toner image to be transferred to the intermediate transfer belt 21, that is, when the printing ratio η1 is greater than 0, the primary transfer current value I1 for the image forming unit 1Y is obtained using the equation 1: I1=13.16*η1=41.66 μA.

When there is no toner image to be transferred to the intermediate transfer belt 21, that is, when the printing ratio η1 is equal to 0, the primary transfer current value I1 for the image forming unit 1Y is obtained using the equation 2: I1=5 μA.

More specifically, in this example, the controller 200 calculates the printing ratio η1 for the Y color image based on image information such as the image data, and controls the primary transfer power source 81Y so as to apply the primary transfer current I1 having a value determined based on the printing ratio using the equation 1 or 2 to the primary transfer roller 25Y.

Further, the developing bias Vb1 of the Y color, which is to be applied by the developer power source 84Y to the developing roller 3*a*Y, is set to −500 V when the toner charge level is −20 μC/g.

Figure 5:
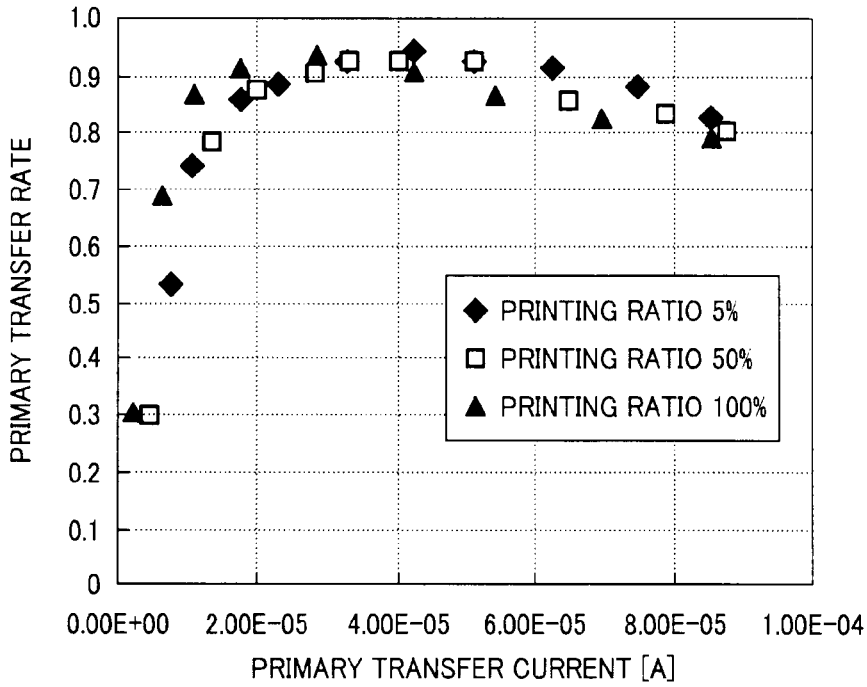
FIG. 5 is a graph illustrating a curve indicating the relationship between a primary transfer rate and a primary transfer current for different printing ratios.

FIG. 5 is a graph illustrating a curve indicating the relationship between a primary transfer rate and a primary transfer current, for a plurality of printing ratios. As illustrated in FIG. 5, the primary transfer current value that corresponds to the maximum value of the primary transfer rate (the peak of the curve) becomes smaller with the increase in the printing ratio, and becomes larger with the decrease in the printing ratio. The primary transfer current value that corresponds to the maximum primary transfer rate varies as a section of the photoconductor 2 having no image formed thereon ("the non-image section") and a section of the photoconductor 2 having an image formed thereon ("the image section") differ in electric charge. Assuming that the initial charge potential of the photoconductor 2 is −650 V, and the electrostatic capacity of the photoconductor 2 is 9.5E-7 F/$m^2$, the area electric charge density of the non-image section of the photoconductor 2 is estimated to be about −620 μC/$m^2$. On the other hand, the area electric charge density of the image section of the photoconductor 2 is a sum of the toner electric charge and the electric charge of the residual potential of the photoconductor 2. The toner electric charge is expressed as 0.60E-3 g/cm2*−20 μC/g=−0.012 μC/$cm^2$=−120 μC/$m^2$. The electric charge of the residual potential of about −100V is about −95 μC/$m^2$. Accordingly, the area charge density of the image section of the photoconductor 2 is estimated to be about −215 μC/$m^2$. The electric charge (about −620 μC/$m^2$) of the non-image section of the photoconductor 2 is about three times greater than that (about −215 μC/$m^2$) of the image section of the photoconductor 2. This indicates that, at the primary transfer nip, the electric field formed between the intermediate transfer belt 21 and the non-image section of the photoconductor 2 is greater than the electric field formed between the intermediate transfer belt 21 and the image section of the photoconductor 2. As the non-image section increases in area size, a larger proportion of the primary transfer current applied through the primary transfer roller 25 will be used for discharge at a position between the intermediate transfer belt 21 and the non-image section of the photoconductor 2. This reduces the amount of primary transfer current that is applied between the intermediate transfer belt 21 and the image section of the photoconductor 2, thus lowering the transfer rate of the toner image. In order to keep the transfer rate relatively high, the primary transfer current should be set high such that a sufficient level of primary transfer current flows between the image section of the photoconductor 2 and the intermediate transfer belt 21. In this example, the transfer rate may be expressed in terms of static electric power in toner.

As indicated by the equation 1, the primary transfer current I1 of the Y color is controlled such that the primary transfer current value I1 decreases with the increase in printing ratio and the primary transfer current I1 increases with the decrease in printing ratio. Even when the printing ratio is low, a sufficient level of current flows between the image section of the photoconductor 2 and the intermediate transfer belt 21 to keep a sufficient level of the transfer rate, thus suppressing the degradation in density of the Y color image.

Next, operation of controlling the primary transfer current Ii and the developing bias Vbi for the image forming units 1M, 1C, and 1K, which are provided downstream of the image forming unit 1Y in the belt transfer direction D of the intermediate transfer belt 21, is explained.

As described above, since the non-image section of the photoconductor 2 is greater in electric charge than the image section of the photoconductor 2, the primary transfer current tends to flow through the non-image section rather than through the image section of the photoconductor 2 such that discharge occurs at the non-image section. This may cause toner in the first toner image previously transferred to the intermediate transfer belt 21, which is not superimposed by the second toner image to be transferred to the intermediate transfer belt 21 and located at a section opposing the non-image section of the photoconductor 2, to be charged with a polarity opposite of the expected negative polarity. Accordingly, toner adhered to the intermediate transfer belt 21 at the section opposing the non-image section of the photoconductor 2 is transferred back to the photoconductor 2. In order to suppress this reverse transfer of toner to the photoconductor 2, the primary transfer current Ii applied to the primary transfer roller 25 may be lowered for the image forming units 1M, 1C, and 1K. However, this causes the transfer rate to decrease such that some toner is not transferred to the intermediate transfer belt 21, thus lowering the image density.

In view of above, in this example, the developing bias Vbi is controlled for the image forming units 1M, 1C, and 1K in addition to the primary transfer current Ii. More specifically, the controller 200 determines the degree of overlap between the first toner image that is previously transferred onto the intermediate transfer belt 21 (the one pixel toner image in the sub-scanning direction D) and the second toner image to be transferred (the one pixel toner image in the sub-scanning direction D) to generate an overlap degree determination result. Based on the overlap degree determination result, the primary transfer current Ii and the developing bias Vbi are determined.

The degree of overlap may be determined based on image data such as an image input signal obtained from an image data input device such as a computer or a scanner connected to the printer 100, or a laser writing signal generated by the optical writing unit 30 for forming a latent image on the photoconductor 2. Further, the positional displacement attributable to the fluctuations in speed of the photoconductor 2 or intermediate transfer belt 21 may be corrected through controlling the timing for starting image writing operation, for example, as described above referring to FIG. 3. By performing correction of a positional displacement, the controller 200 is able to obtain the degree of overlap based on image information such as the image data with high accuracy. More specifically, based on the image information such as the image data, the controller 200 may obtain the position of the first toner image to be transferred to the intermediate transfer belt 21 and the position of the second toner image to be transferred to the intermediate transfer belt 21, and determine the degree of overlap between the first image and the second image to generate the overlap degree determination result. In this example, the first toner image is any toner image that is to be transferred from a first image forming unit that is upstream in the belt transfer direction D to the intermediate transfer belt 21, and the second toner image is any toner image that is to be transferred from a second image forming unit that is downstream of the first image forming unit in the belt transfer direction D to the intermediate transfer belt 21.

Referring now to FIGS. 6A to 6E, operation of obtaining the developing bias Vbi for the M, C, and K colors is explained. In this example, it is assumed that the toner charge amount is −20 μC/g. Further, the toner image formed or to be formed on the intermediate transfer belt 21 has a size that is one pixel in the sub-scanning direction D.

FIG. 6A illustrates a case in which the intermediate transfer belt 21 does not have any first toner image that is previously transferred at a predetermined area of the intermediate transfer belt 21, when transferring the second toner image from the photoconductor 2 to the predetermined area of the intermediate transfer belt 21. FIGS. 6B, 6C, and 6D each illustrate a case in which the second toner image is transferred from the photoconductor 2 to the intermediate transfer belt 21 having the first toner image that is previously transferred to the intermediate transfer belt 21. In FIG. 6D, the second toner image to be transferred to the intermediate transfer belt 21 will be superimposed on the entire area of the first toner image that is previously transferred to the intermediate transfer belt 21. In any one of FIGS. 6B and 6C, the second toner image to be transferred to the intermediate transfer belt 21 is not superimposed over the entire section of the first toner image that is previously transferred to the intermediate transfer belt 21 such that there is a portion of the second toner image to be transferred that is not superimposed on the first toner image previously transferred to the intermediate transfer belt 21. FIG. 6E illustrates a case in which there is no second toner image to be transferred to the intermediate transfer belt 21 that carries the first toner image that is previously transferred.

In either case of FIG. 6A or FIG. 6D, the developing bias Vbi for the image forming unit M, C, or K is obtained using the equation 3: Vbi=−500 V.

In either case of FIG. 6B or FIG. 6C, the developing bias Vbi for the image forming unit M, C, or K is obtained using the equation 4: Vbi=24.7*ηi−541.

In this example, the controller 200 controls the developing bias Vbi, pixel by pixel in the sub-scanning direction D, i.e., the belt transfer direction D, based on the printing ratio ηi of the second toner image in the main scanning direction X (the direction perpendicular to the belt transfer direction). The printing ratio ηi of the second toner image, i.e., the printing ratio ηi for the image forming unit 1M, 1C, or 1K, may be obtained from the latent image detected at an exit of the developing area where the standing magnetic brush of the developing roller 3*a* is made in contact with the photoconductor 2. When the photoconductor 2 is rotated by one pixel in the sub-scanning direction D, the printing ratio at the exit of the developing area changes. This causes the developing bias Vbi to change according to the printing ratio. Alternatively, the printing ratio ηi may be obtained based on image information including image data such as an image input signal of an image data input device or a laser writing signal of the optical writing unit 30. Further, in this example, the printing ratio is between 0 and 1.

The primary transfer current Ii of the primary transfer rollers 25M, 25C, or 25K is obtained as follows when the toner charge is −20 μC/g.

When there is the second toner image to be transferred, that is, when the printing ratio ηi is greater than 0, and in either case of FIG. 6A or 6D, the primary transfer current value Ii for the image forming unit 1M, 1C, or 1K is obtained using the equation 5: Ii=−13.16*ηi+41.66 μA.

When there is the second toner image to be transferred, that is, when the printing ratio ηi is greater than 0, and in either case of FIG. 6B or 6C, the primary transfer current value Ii for the image forming unit 1M, 1C, or 1K is obtained using the equation 6: Ii=20 μA.

When there is no second toner image to be transferred, that is, when the printing ratio ηi is equal to 0 as illustrated in FIG. 6E, the primary transfer current value Ii for the image forming unit 1M, 1C, or 1K is obtained using the equation 7: Ii=5 μA.

In this example, as described above, the primary transfer current Ii is controlled based on the degree of overlap between the first and second toner images, which is detected or to be detected at the exit of the primary transfer nip. When the intermediate transfer belt 21 and the photoconductor 2 rotate by one pixel in the sub-scanning direction D, the degree of overlap between the first and second toner images at the exit of the primary transfer nip changes. This causes the primary transfer current that flows the primary transfer roller 25 to have a value changed according to the degree of overlap of the first and second toner images. As described above, the primary transfer current that is applied to the primary transfer roller 25 mainly flows through the exit of the primary transfer nip, thus causing discharge of the non-image section of the photoconductor 2 at the exit of the primary transfer nip. When the degree of overlap between the first and second toner images indicates that there is a portion in which the first and second toner images do not overlap, reverse transfer may occur due to the discharge in the non-image section of the photoconductor 2. In order to suppress this reverse transfer of toner back to the photoconductor 2, the controller 200 controls the primary transfer current based on the degree of overlap of the first and second toner images to be detected at the exit of the primary transfer nip.

FIG. 7 is a graph illustrating the relationship between the reverse transfer rate of M color toner and the primary transfer current of the image forming unit 1K for the K color when the printing ratios for the M color toner and the K color toner are each 5 percent. In this example, the reverse transfer rate is obtained as a ratio between an amount of M color toner that is reverse transferred to the photoconductor 2K of K color and an amount of M color toner that is transferred to the intermediate transfer belt 21. In this example, the K color toner is transferred to the intermediate transfer belt 21 such that the K color toner is not superimposed by the M color toner in the M color toner image formed on the intermediate transfer belt 21. As described above, when the printing ratio of the K color toner is 5 percent, the primary transfer current of 41.0 μA is required as indicated by the equation 5 to obtain the optimum level of the primary transfer rate. The graph of FIG. 7 indicates that the reverse transfer rate of the M color toner starts to increase when the primary transfer current for the K color exceeds 20 μA. For this reason, in any one of the image forming units 1M, 1C, and 1K, the primary transfer current Ii is set to 20 μA in case when reverse transfer is most likely to occur. For example, when there is a portion of the first toner image that is not superimposed by the second toner image but faces a non-image section of the photoconductor 2, the controller 200 determines that reverse transfer is most likely to occur, and sets the primary transfer current to 20 μA. More specifically, in either case of FIG. 6B or 6C, the controller 200 determines that there is a portion of the first toner image that is not superimposed by the second toner image, and controls the primary transfer current to have the value of 20 μA using the equation 6 rather than controlling the primary transfer current according to the printing ratio ηi. This suppresses reverse transfer of toner in the portion of the first toner image that is not superimposed by the second toner image.

If the transfer rate of toner is controlled at the primary transfer current of 20 μA, the transfer rate is made lower than the transfer rate of about 95% which is obtained when the transfer current is controlled according to the printing ratio ηi. For example, in case of printing ratio of 100%, the transfer rate decreases by about 3% if the primary transfer current is fixed at 20 μA as compared to the case in which the primary transfer current is controlled based on the printing ratio. In case of printing ratio of 5%, the transfer rate decreases by about 5% if the primary transfer current is fixed at 20 μA as compared to the case in which the primary transfer current is controlled based on the printing ratio. With the lowered transfer rate, it would not be possible to transfer a sufficient amount of toner to the intermediate transfer belt 21, thus decreasing image density. In view of this, in either case of FIG. 6B or 6C, as indicated by the equation 4, the developing bias Vbi is controlled while taking into account the decrease in transfer rate attributable to controlling the primary transfer current to be 20 μA. More specifically, the developing bias is controlled so as to increase the amount of toner to be applied to the photoconductor 2. As indicated by the equation 4, with the decreased printing ratio ηi, the developing bias Vbi increases so as to have a negative polarity. Further, with the decreased printing ratio ηi, the amount of toner to be adhered to the image section of the photoconductor 2 increases. As a result, even when the transfer rate decreases as the primary transfer current is fixed at 20 μA, the amount of toner to be adhered onto the photoconductor 2 increases while taking into account the lowered transfer rate. This causes a sufficient level of toner to be transferred to the intermediate transfer belt 21, thus suppressing decrease in image density. Even when there is a portion of the first toner image that is not overlapped with the second toner image as illustrated in FIG. 6B or 6C, reverse transfer of toner in that portion is suppressed. Further, a sufficient level of toner is transferred to the intermediate transfer belt 21, thus increasing image quality.

On the other hand, when the controller 200 determines that the second toner image superimposes over the entire section of the first toner image formed on the intermediate transfer belt 21 as illustrated in FIG. 6D, toner of the first toner image formed on the intermediate transfer belt 21 is not made in direct contact with the photoconductor 2. Accordingly, it is unlikely that the toner of the first toner image formed on the intermediate transfer belt 21 is transferred back to the photoconductor 2. When there is no first toner image on the intermediate transfer belt 21 as illustrated in FIG. 6A, reverse transfer of toner does not occur. In either case of FIG. 6A or 6D, using the equation 3, the developing bias Vbi is set to −500 V, which is the value of a developing bias that corresponds to a toner level that is set by default. The primary transfer current Ii is then controlled according to the printing ratio ηi as indicated by the equation 5. In this manner, a desired level of toner is transferred to the intermediate transfer belt 21, while suppressing an amount of residual toner.

When there is no second toner image to be transferred as illustrated in FIG. 6E, as indicated by the equation 7, the primary transfer current Ii is reduced to a fixed value of 5 μA. With the small value of primary transfer current, discharge that may be otherwise caused at the primary transfer nip may be suppressed. This prevents toner formed on the intermediate transfer belt 21 to be charged with a polarity opposite to the expected polarity, and occurrence of reverse transfer of toner is suppressed. In this manner, degradation in image quality or toner mix within the developing unit 3 is suppressed.

As described above, in this example, the primary transfer current I1 for the image forming unit 1Y is controlled according to the printing ratio of the Y color image, thus maintaining a high level of transfer rate. The primary transfer currents Ii for the image forming units 1M, 1C, and 1K are respectively controlled according to the printing ratios of the M, C, and K image, thus maintaining a high level of transfer rate. In a substantially similar manner, the primary transfer current for the color image of blue, red, or green may be controlled according to the printing ratio of blue, red, or green image. In this example, the blue, red, or green color may be each generated by combining toner of two different colors selected from Y, M, C, and K. Further, in this example, 95% of transfer rate may be referred to as the high level of transfer rate.

For most cases, the image to be printed out by an image forming apparatus such as the printer 100 contains characters or graphs such that the printed image data does not have a plurality of colors in the main scanning direction X. In other words, there is only a limited number of cases of FIG. 6B and FIG. 6C. Since the primary transfer current is controlled according to the printing ratio for most cases, the image forming apparatus is able to achieve the high transfer rate, thus the high image quality.

In the background image forming apparatus, the primary transfer current is fixed at 25 μA, with the transfer rate of 90% to 93%. In such case, for each one of the colors, about 5% of toner formed on the intermediate transfer belt 21 is transferred back to the photoconductor 2 as the toner image is transferred through the primary transfer nip. For example, assuming that the yellow toner image formed on the photoconductor 2 has a printing ratio of 5%, the possibility for the yellow toner image to pass the primary transfer nip at the image forming unit 1K, which is provided most downstream in the belt transfer direction, is about 77%, which is obtained from the equation: 90%*(1−0.05)*(1−0.05)*(1−0.05).

In contrary, in this example, in case of printing the color image such as a picture image, the degree of overlap between the first and second images tends to increase as described above referring to FIG. 6B or 6C. Accordingly, the transfer rate at the primary transfer nip for M, C, and K is reduced. For example, the transfer rate is 88% in case the printing ratio is 5%, and is 92% in case the printing ratio is 100%. Even when the transfer rate decreases, the developing bias Vbi is controlled so as to increase the amount of toner in the second toner image to be transferred such that a desired amount of toner is transferred to the intermediate transfer belt 21. Further, since the primary transfer current is fixed at 20 μA, reverse transfer of toner is suppressed, for example, to be around about 2%.

When there is no toner image previously formed at the nip, for example, in the case of transferring the Y color image formed at the image forming unit 1Y that is most upstream in the belt transfer direction to the intermediate transfer belt 21, the primary transfer current is controlled according to the printing ratio of the Y color image. This allows the image forming apparatus to obtain 95% of transfer rate. For example, assuming that the yellow toner image formed on the photoconductor 2Y has a printing ratio of 5%, the possibility for the yellow toner image to pass the primary transfer nip at the image forming unit 1K, which is provided most downstream in the belt transfer direction, is about 89%, which is obtained from the equation: 95%*(1−0.02)*(1−0.02)*(1−0.02). Even under the condition in which the transfer rate is low and the occurrence of revere transfer is high, the transfer rate of about 85% is obtained for the M toner image without increasing the amount of toner in the second toner image to be transferred. The transfer rate of 85% is obtained using the equation: 88%*(1−0.02)*(1−0.02)*(1−0.02). Under the condition in which the transfer rate is relatively high, the transfer rate of about 91% is obtained for the M toner image using the equation: 95%*(1−0.02)*(1−0.02)*(1−0.02). On the other hand, in the case of using the background technique, the transfer rate obtained is about 81% using the equation: 95%*(1−0.05)*(1−0.05)*(1−0.05).

Further, in this example, the amount of toner applied to the second toner image to be transferred, which is formed on the photoconductor 2, is set so as to have a toner mass per unit area of equal to or greater than 0.6 mg/cm$^2$ to compensate the reduced transfer rate. In such case, the amount of M toner after passing the primary transfer nip of the image forming unit 1K becomes equal to or greater than 85% or 91%.

More specifically, in this example, when there is a portion of the second toner image to be transferred that does not overlap the first toner image previously transferred, the transfer current is not controlled according to the printing ratio but kept at a low level, thus suppressing the problem of reverse transfer. In order to compensate the lowered transfer rate due to the low primary transfer current, an amount of toner to be adhered to form the second toner image is increased.

As described above, the image forming apparatus of this example such as the printer 1 is able to output the high quality image without causing toner mix even when the cleaner-less method is applied.

In the above-described example, the primary transfer current is determined based on the printing ratio when there is no portion in the second toner image to be transferred that does not overlap the first toner image previously transferred. For example, the primary transfer current for the Y color is calculated based on the printing ratio of Y image as there is no first toner image previously transferred. In another example, as described above referring to FIG. 6A or FIG. 6D, the primary transfer current for each of M, C, and K colors is calculated based on the printing ratio of the respective color.

Alternatively, the primary transfer current may be obtained while additionally considering the toner charge or photoconductor potential. This is because a combination of the transfer current value and the printing ratio that corresponds to the highest transfer rate or a threshold of primary transfer current causing the increase in reverse transfer tends to vary depending on potential of the non-image section and the image section of the photoconductor, and toner charge, etc. The potential of the non-image section and the image section of the photoconductor, and toner charge tend to vary depending on temperature or humidity. As illustrated in FIG. 1, the printer 100 of FIG. 1 may be provided with the temperature/humidity (TEMP/HUM) sensor 85. Based on sense information of the temperature/humidity sensor 85, the controller 200 estimates the toner charge or the potential of the non-image and image section of the photoconductor, and corrects the equation for obtaining the primary transfer current based on the estimated result. More specifically, when the controller 200 determines that the toner charge increases based on the sense information of the temperature/humidity sensor 85, a coefficient in the equation 1 or equation 5, such as the coefficient −13.16, is corrected so as to output the higher value of primary transfer current.

For example, in case of equation 1, when the toner charge changes under the condition where the initial potential of the photoconductor is fixed at −650 V and the toner amount on the photoconductor is fixed at 0.6 mg/cm$^2$, the function for obtaining the primary transfer current while considering the toner charge is expressed as follows.

$$I1=-(13.06+\{(Q1+20)/20\}*8.01)\eta 1+41.66,$$

where Q1 is toner charge (μ/g).

As indicated by the above-described function, the primary transfer current of the black-solid image having the printing ratio of 100% increases as the toner charge increases.

Further, since the change in processing linear speed affects the amount of toner to be transferred per unit time or the amount of current being discharged, the coefficient in the equation may be corrected based on the processing linear speed. For example, the function for obtaining the primary transfer current may be expressed as follows while considering the process linear speed.

$$I1=(-13.16*\eta 1+41.66)vp/280,$$

with vp corresponding to a processing linear speed in mm/s.

As indicated by the above-described equation, the primary transfer current is controlled so as to increase with the increase in processing speed.

Further, as the amount of toner adhered onto the photoconductor surface changes depending on the potential of non-image section and image section of the photoconductor, and toner charge, the coefficient in the equation 4 may be corrected based on an estimated result of the potential of non-image section and image section of the photoconductor and toner charge, which is obtained based on sense information of the temperature/humidity sensor 85.

In the above-described example, the primary transfer current is calculated using the functions. Alternatively, a look-up table may be provided, which stores the toner charge, printing ratio, charge potential of the photoconductor, and the primary transfer current, in a corresponding manner. Using the look-up table, the primary transfer current may be determined, which corresponds to the obtained combination of the toner charge, printing ratio, and charge potential of the photoconductor. Further, the look-up table may be commonly shared for different colors. Alternatively, the look-up table may be prepared for each one of the colors. In the case of providing a look-up table, the look-up table is stored in a memory of the printer 100 such as the RAM 200*c*.

In the above-described example, the developing bias Vbi for M, C, or K colors is obtained using the equation 4, in case there is a portion of the second toner image to be transferred that does not overlap the first toner image previously transferred. Alternatively, a look-up table may be provided, which stores the printing ratio and the developing bias. The developing bias may be obtained using the look-up table. The look-up table may be stored in a memory of the printer 100 such as the RAM 200*c*.

In the above-described example, the function for obtaining the primary transfer current based on the printing ratio is common for all colors. Alternatively, such function for obtaining the primary transfer current based on the printing ratio may be prepared for each one of the plurality of colors. Further, the function for obtaining the developing bias in case there is a portion of the first and second images not overlapping with each other such as the equation 4 is made common for all colors. Alternatively, such function for obtaining the developing bias may be prepared for each one of a plurality of colors.

Further, in this example, a reference value of the primary transfer current is determined based on a printing ratio that is detected or to be detected at an exit of the primary transfer nip. Alternatively, the reference value of the primary transfer current may be determined in various other ways, for example, according to the responsiveness of the primary transfer power source 81. For example, even when the primary transfer current is set to have a reference value determined based on the printing ratio to be detected at the exit of the primary transfer nip, the primary transfer current that is detected from the subjected image may differ due to the responsiveness of the power source 81 such that the actual primary transfer current may have the reference value after the subjected image has passed the exit of the primary transfer nip. In such case, the printing ratio detected at a mid position of the primary transfer nip may be set as the reference transfer current value to reflect the responsiveness of the primary transfer power source 81. In this manner, the primary transfer current at the exit of the primary transfer nip has a reference value determined based on the printing ratio to be detected at the exit of the primary transfer nip.

In case of implementing the cleaner-less method, the residual toner is collected by the developing unit 3 for later use. Since residual toner is recycled, in the cleaner-less method, the primary transfer current or amount of toner may be controlled with a larger range. For example, the controller 200 may determine the degree of overlap between the first toner image that is previously transferred and the second toner image to be transferred every time the intermediate transfer belt 21 moves by 100 pixels in the sub-scanning direction D. In such case, every time the intermediate transfer belt 21 is transferred by 100 pixels, the primary transfer current or the developing bias is changed. More specifically, when the determination result indicates that there is a portion of the second toner image to be transferred that does not overlap the first toner image that is previously transferred, the controller 200 controls a developing bias based on the printing ratio obtained based on the 100 pixels of an image in the sub-scanning direction. When the determination result indicates that the second toner image to be transferred overlaps over the entire section of first toner image previously transferred, or there is no first toner image previously transferred, the controller 200 controls a primary transfer current based on the printing ratio obtained from 100 pixels of an image in the sub-scanning direction.

Further, the degree of overlap between the first toner image and the second toner image may be obtained based on unit of the primary transfer nip width or based on unit of the pixels contained in one sheet of image. In case of controlling the primary transfer current or developing bias based on the primary transfer nip width, the primary transfer current or developing bias may be controlled by every (primary transfer nip width/processing linear speed) second. Alternatively, the primary transfer current and the developing bias may be controlled by every 1000 pixels in the sub-scanning direction. In such case, the controller 200 determines the degree of overlap between the first toner image and the second toner image by 1000 pixels in the sub-scanning direction. Every time the intermediate transfer belt 21 is transferred by 1000 pixels, the values of the primary transfer current and the developing bias are determined and changed as needed.

For example, the following explains the example in which the primary transfer current and the developing bias are controlled based on the unit of one sheet of image.

Assuming that there is the second toner image to be transferred that is formed on the photoconductor in case when there is no first toner image (one-sheet image) previously formed on the intermediate transfer belt 21, or when the second toner image to be transferred overlaps over the entire first toner image formed on the intermediate transfer belt 21, the primary transfer current is set to Ii=26 μA. The developing bias is set to Vbi=−500 V so as to keep the amount of toner unchanged.

Assuming that there is the second toner image to be transferred that is formed on the photoconductor in case when the second toner image (one-sheet image) does not overlap the entire first toner image (one-sheet toner image) previously transferred, the primary transfer current is set to Ii=20 μA. The developing bias is set equal to or greater than Vbi=−500 V so as to cause the amount of toner to increase.

Assuming that there is no second toner image to be transferred on the photoconductor, the primary transfer current is set to Ii=5 μA.

In alternative to the case when the controller 200 determines the degree of overlap between the second toner image and the first toner image every one pixel in the sub-scanning direction, the primary transfer current or the developing bias may be controlled based on the printing ratio with a wider range. For example, the controller 200 calculates the printing ratio based on an image of 100 pixels in the sub-scanning direction. Every time the intermediate transfer belt 21 is transferred by 100 pixels, the primary transfer current or the developing bias is changed according to the calculated printing ratio. Alternatively, the primary transfer current value or the developing bias that is to be controlled according to the printing ratio may be determined using the average printing ratio obtained by averaging the printing ratios of the one-sheet image.

In alternative to the image forming apparatus employing the cleaner-less method, any one of the above-described methods of controlling the primary transfer current or the developing bias may be applied to any desired image forming apparatus such as an image forming apparatus that cleans the residual toner. In the case of image forming apparatus that cleans the residual toner, toner mix in the developing unit 3 does not occur. For this reason, the controller 200 may determine the degree of overlap with a wider range. For example, from the image information, Y, M, C, and K color information is obtained. Using the Y, M, C, and K color information, the number of pixels to be printed in the sub-scanning direction is counted for each one of Y, M, C, and K colors. When transferring the second toner image to be transferred onto the intermediate transfer belt 21, the number of pixels in the second toner image that corresponds to one pixel in the sub-scanning direction and the number of pixels in the first toner image previously formed on the intermediate transfer belt 21 are compared. If they match, the controller 200 determines that the first toner image and the second toner image entirely overlap. When they do not match, the controller 200 determines that the first toner image and the second toner image do not entirely overlap. In this manner, the processing speed for generating a determination result indicating the degree of overlap increases. However, there may be a risk that the controller 200 outputs a determination result indicating that the second toner image overlaps the entire first toner image based on the number of pixels, as long as the number of pixels for the first and second images match. Even in such case, the image forming apparatus cleans the residual toner left after image forming, thus the negative influence is suppressed. Further, the above-described method of determining the degree of overlap may be performed by the image forming apparatus implementing the cleaner-less method when improving the processing speed is more desirable than suppressing the problem of toner mix.

In the above-described example, the amount of toner adhered to the photoconductor 2 is controlled by changing a developing bias. Alternatively, the power or the exposure time of the optical writing unit 30 that forms a latent image on the photoconductor 2 may be controlled to change the amount of toner adhered to the photoconductor 2. Alternatively, the developing bias and the exposure level may be both controlled to change the amount of toner adhered to the photoconductor 2.

Alternatively, the charge potential between the charging unit 4 and the photoconductor surface may be controlled to change the amount of toner adhered to form the second toner image. For example, if the controlled developing bias causes a problem in which the developing unit 3 develops toner or carrier on the non-image section of the photoconductor 2, the charge potential of the photoconductor 2 may be controlled according to the image information such as the printing ratio. Especially in case of implementing the cleaner-less method, the developing unit 3 collects therein residual toner left on the photoconductor surface due to the difference in potential between the charge potential of the photoconductor 2 and a developing sleeve. Since the collection capability is kept constant, this may be an effective method.

Further, in this example, the positional displacement attributable to the fluctuations in rotational speed of the photoconductor 2 or the intermediate transfer belt 21 is corrected by controlling a timing at which the optical writing unit 30 starts image formation on the photoconductor 2. In this manner, the degree of overlap between the first toner image and the second toner image is obtained using the image information with high accuracy. The degree of overlap may be obtained with high accuracy in various other ways. For example, the rotational speeds of the intermediate transfer belt 21 and the photoconductor 2 are respectively detected to generate a determination result. Based on the determination result, the intermediate transfer belt 21 and the photoconductor 2 are respectively controlled so as to rotate in a predetermined rotational speed. This allows the degree of overlap between the first toner image and the second toner image to be obtained using the image information with high accuracy.

Figure 8:
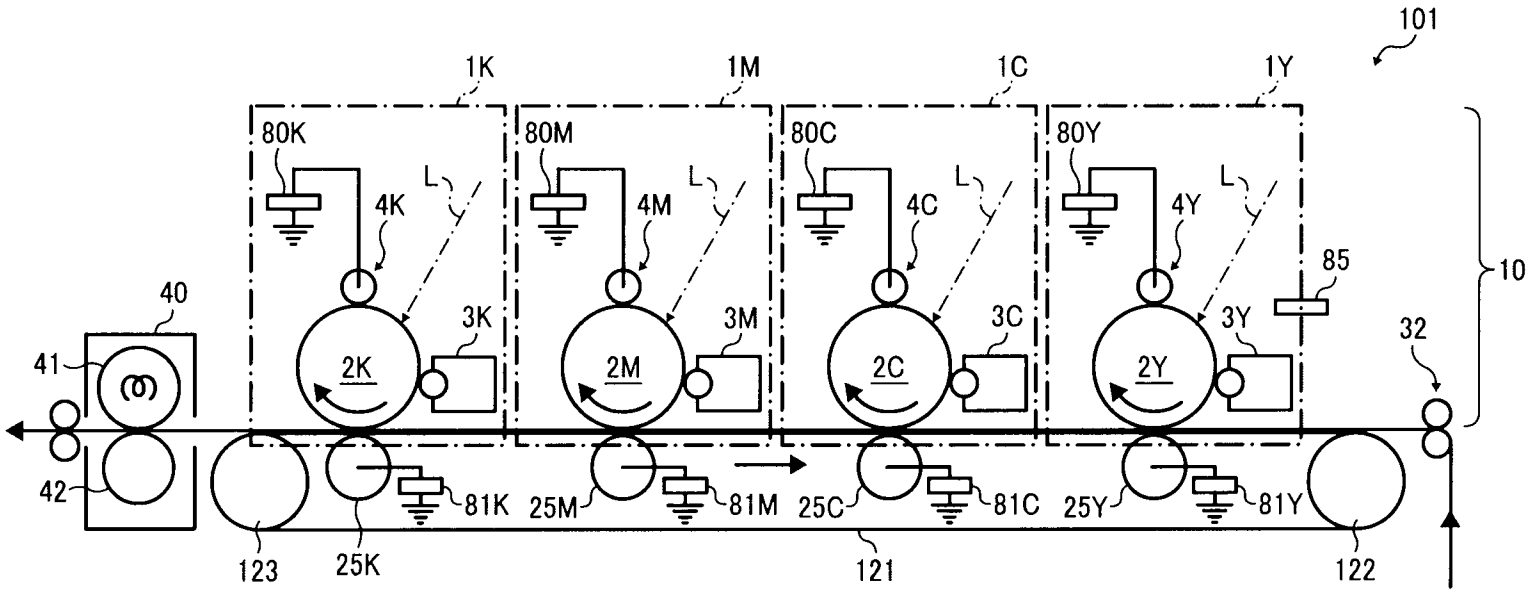
FIG. 8 is a cross-sectional diagram illustrating a selected portion of an image forming apparatus of a direct transfer tandem type according to an example embodiment of the present invention.

Further, in alternative to the printer 100 having the tandem-type image forming device 1 employing an intermediate transfer method, any one of the above-described methods of controlling the primary transfer current or the developing bias may be applied to an image forming apparatus provided with a tandem-type image forming device employing a direct transfer type. As illustrated in FIG. 8, an image forming apparatus 101 of direct transfer type transfers the toner image formed on the photoconductor 2 of the image forming device 10 directly onto a recording sheet, which is carried by a transfer belt 121. In this example, the transfer belt 121 is wound around two rollers 122 and 123, and rotated in the counterclockwise direction to transfer the recording sheet from the registration roller pair 32 to the fixing device 40. More specifically, in this example, the recording sheet carried by the transfer belt 21 functions as a transfer body.

Figure 9:
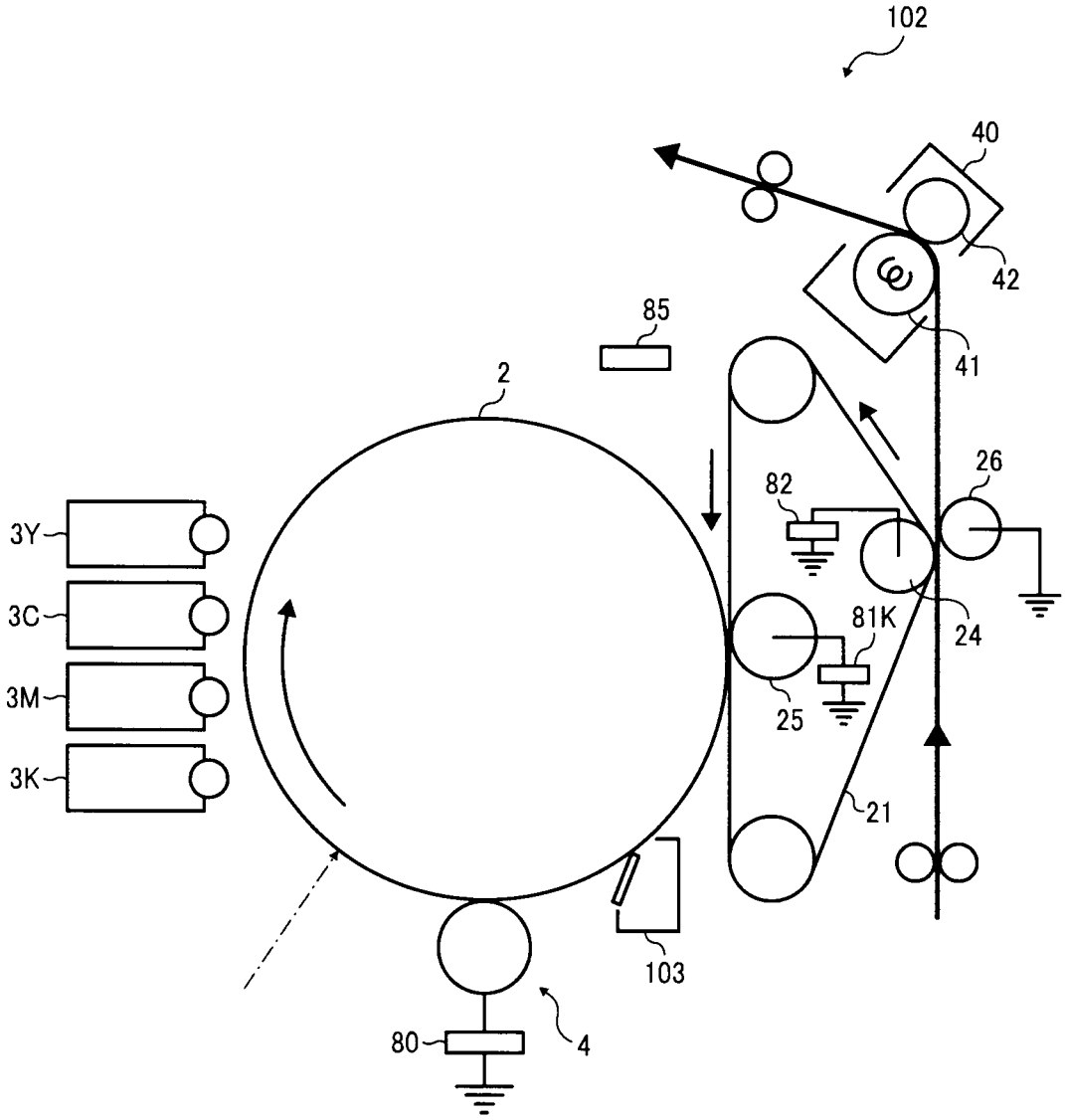
FIG. 9 is a cross-sectional diagram illustrating a selected portion of an image forming apparatus of one drum type according to an example embodiment of the present invention.

Alternatively, any one of the above-described methods of controlling the primary transfer current or the developing bias may be applied to a one-drum type image forming apparatus 102 as illustrated in FIG. 9. The image forming apparatus 102 of FIG. 9 includes an image forming unit having a plurality of developing units respectively provided around one photoconductor 2. More specifically, the image forming unit includes a charging unit 4, and a plurality of developing units 3Y, 3C, 3M, and 3K (collectively referred to as the developing unit 3). In order to perform image formation, the charging unit 4 uniformly charges the surface of the photoconductor 2. The laser light L, which is modulated based on Y color image data, is irradiated onto the surface of the photoconductor 2 to form a Y color latent image thereon. The Y color latent image is developed by the developing unit 3Y with Y toner into the Y color toner image. The Y toner image is transferred onto an intermediate transfer belt 21. After a cleaning unit 103 removes residual toner that resides on the surface of the photoconductor 2, the charging unit 4 uniformly charges the surface of the photoconductor 2. Next, the laser light L, which is modulated based on the M color image data, is irradiated toward the surface of the photoconductor 2 to form the M color latent image thereon. The M color latent image is developed by the developing unit 3M with the M color toner into the M color toner image. The M color toner image is transferred onto the intermediate transfer belt 21, while being superimposed over the Y toner color image that is transferred to the intermediate transfer belt 21. In a substantially similar manner, the C color toner image and the K color toner image are respectively transferred to the intermediate transfer belt 21. The full-color composite toner image, which is generated by superimposing the toner images of different colors, is transferred to the recording sheet at a secondary transfer nip, which is provided between the first and second secondary transfer rollers 24 and 26. The recording sheet having the composite color toner image thereon is transferred to the fixing device 40. The fixing device 40 fixes the toner image to the recording sheet by heat and pressure. The recording sheet having the fixed image thereon is discharged onto a discharge tray.

The image forming apparatus 102 of FIG. 9 of one-drum type may suffer from the problem of reverse transfer unless a controller 200 is not provided to control operation of image formation. When there is a portion of the first toner image previously transferred that is not superimposed by the second toner image to be transferred, such portion is made in contact with the non-image section of the photoconductor surface such that toner may be transferred from that portion back to the photoconductor surface.

By applying any one of the above-described methods of controlling the primary transfer current or developing bias, the image forming apparatus 102 of FIG. 9 is able to suppress reverse transfer in which the transferred toner image is transferred back from the intermediate transfer belt 21 to the photoconductor 2. Further, a desired amount of toner is transferred to the intermediate transfer belt 21, thus suppressing the lowered image density.

As described above, in this example, the controller 200 generates a determination result indicating the degree of overlap between the second toner image to be transferred and the first toner image previously transferred. When the determination result indicates that the first toner image formed on the intermediate transfer belt 21 has a portion that is not superimposed by the second toner image to be transferred, the controller 200 controls the developing bias so as to generate a transfer electric field that is less than the transfer electric field expected to be generated when the second toner image is transferred to an non-image section of the intermediate transfer belt 21 having no first toner image previously transferred in the main scanning direction or the width direction of the intermediate transfer belt 21. This reduces the electric current that flows between the non-image section of the photoconductor surface and the primary transfer roller 25. This further suppresses toner in the first toner image previously transferred at the section that is not superimposed by the second toner image to be transferred to have a polarity opposite to the expected polarity, thus preventing toner in the first toner image at the section that is not superimposed by the second toner image to be transferred back to the photoconductor 2. Accordingly, the decrease in amount of toner formed on the intermediate transfer belt 21 is suppressed to provide high image quality.

In case of applying the cleaner-less method, the above-described control of primary transfer current prevents the toner having a specific color to be collected into the developing unit 3 for a different color and mixed with the different color toner. In this manner, the degradation in color reproducibility is suppressed.

If the transfer electric field is reduced, the transfer rate decreases. In view of this, when the determination result generated by the controller 200 indicates that there is a section of the first toner image that is previously transferred that is not superimposed by the second toner image to be transferred, the controller 200 controls the amount of toner to be adhered to form the second toner image formed on the photoconductor 2 to be greater than the amount of toner to be adhered to form the second toner image formed on the photoconductor 2 that is expected to be obtained when the second toner image is transferred to an non-image section of the intermediate transfer belt 21 having no first toner image that is previously transferred in the main scanning direction. Even when the transfer rate decreases, since the amount of toner adhered to form the second toner image is controlled to increase, a desired amount of toner is adhered to the intermediate transfer belt 21 to form the second toner image. This suppresses the degradation in image density of the toner image formed on the intermediate transfer belt 21, thus improving the image quality.

The primary transfer roller 25 is applied with a transfer bias by the power source 81 at a current having a predetermined value. When the determination result generated by the controller 200 indicates that there is a portion of the first toner image previously transferred that is not superimposed by the second toner image to be transferred, the controller 200 controls a primary transfer current to have a value less than the primary transfer current value that is expected to be obtained when the second toner image to be transferred is transferred to an non-image section of the intermediate transfer belt 21 having no first toner image previously transferred in the main scanning direction. This reduces a current that flows between the non-image section of the photoconductor surface and the primary transfer roller 25. Accordingly, toner in the first toner image previously transferred, which is located at a section that is not superimposed by the second toner image to be transferred, to transfer back to the photoconductor.

In case when the second toner image to be transferred is transferred to an non-image section of the intermediate transfer belt 21 having no first toner image previously transferred in the main scanning direction, or in case when the determination result indicates that the first toner image and the second toner image overlap throughout the entire section, the controller 200 controls a primary transfer current to decrease with the decrease in printing ratio of the image. In case when the second toner image to be transferred is transferred to an non-image section of the intermediate transfer belt 21 having no first toner image previously transferred in the main scanning direction, or in case when the determination result indicates that the first toner image and the second toner image overlap throughout the entire section, there is no section in which the first toner image and the non-image section of the photoconductor are made in contact with each other. In other words, there is no chance that toner applied to form the first toner image previously transferred is transferred back to the photoconductor. In such case, the controller 200 controls the value of a primary transfer current to decrease as the printing ratio of the image decreases so as to obtain a desired level of transfer rate. Since the desired level of transfer rate is obtained, the amount of toner to be adhered to form the second toner image to be transferred does not have to be changed to cause a desired amount of toner to be transferred to the intermediate transfer belt 21. This prevents toner to be wasted especially when no cleaner-less method is implemented.

When the determination result generated by the controller 200 determines that the first toner image previously formed on the intermediate transfer belt 21 has a portion that is not superimposed by the second toner image to be transferred, the controller 200 controls the amount of toner adhered to form the second toner image to increase with the decrease in printing ratio of the second toner image. If the developing bias is to be controlled at a current having a predetermined value, the transfer current needs to be set at a larger value for the lower printing ratio to obtain a sufficient level of transfer rate. When the first toner image previously transferred has a portion that is not superimposed by the second toner image to be transferred, and the transfer current is made less, the transfer rate of the second toner image is greatly reduced especially when the printing ratio of the second toner image is low. In view of this, the controller 200 controls the amount of toner to be adhered to form the second toner image to increase with the decrease in printing ratio of the second toner image. Even when the printing ratio of the second toner image is low, a sufficient amount of toner is transferred to the intermediate transfer belt 21, thus suppressing the degradation in image density.

Further, by controlling the developing bias, the amount of toner applied to form the second toner image to be transferred is controlled at a sufficient level.

When there is no second toner image to be transferred, the controller 200 controls the developing bias so as to cause a transfer electric field that is less than the transfer electric field applied when transferring the first toner image that is previously transferred. This prevents toner applied to form the first toner image formed on the intermediate transfer belt 21 to have a polarity opposite to the expected polarity due to the transfer current, and transfer back to the photoconductor.

At least one of the toner charge, temperature, humidity, and processing linear speed such as the transfer body transferring speed may be detected to generate a detection result. The controller 200 may control the transfer bias based on the detection result to obtain a sufficient level of transfer rate.

In case of applying the cleaner-less method, the developing unit 3 collects the residual toner left on the photoconductor surface. The disposed toner tank for collecting the residual toner or a recycle toner transfer route for transferring the residual toner to be recycled does not have to be provided. With the use of cleaner-less method, the image forming apparatus may be made smaller in size while reducing the number of members, thus reducing the overall manufacturing cost. Even with the cleaner-less method, the controller 200 is able to control the primary transfer current or the developing bias so as to suppress the reverse transfer or the toner mix.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

For example, in any one of the above-described examples, the amount of toner to be adhered to form the second toner image may be controlled in various other ways in alternative to controlling a developing bias to be applied to the developing unit. In one example, the controller 200 may control the level of light exposure to be irradiated by the optical writing unit 30 onto the surface of the photoconductor 2. In order to increase the amount of toner to be adhered, the controller 200 causes the optical writing unit 30 to increase the level of the light exposure. For example, in case of forming the solid image, rather than keeping the duty ratio of the light to be 100%, the controller 200 causes the optical writing unit 30 to irradiate the light having a duty ratio of 50% as the optical writing unit 30 writes one pixel in the main scanning direction. As the duty ratio changes, the potential of an exposure unit of the optical writing unit changes, thus resulting in the change in toner amount to be adhered.

Alternatively, the controller 200 may cause the optical writing unit 30 to increase the size of an area to be exposed by the light irradiated by the optical writing unit 30, for example, by causing the optical writing unit 30 to increase a duration of time for irradiating the light onto the surface of the photoconductor 2.

In another example, the controller 200 may control the charging unit such as a charging roller provided in the charging unit to change an electric potential of the photoconductor 2. In order to increase the amount of toner to be adhered, the controller 200 causes the optical writing unit 30 to decrease the charging potential of the charging unit.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming apparatus including: a plurality of latent image carriers; a plurality of image forming devices respectively provided for the plurality of latent image carriers to form a plurality of toner images on the plurality of latent image carriers by applying toner to the plurality of latent image carriers; transferring means applied with a transfer bias by a power source to cause the plurality of toner images formed on the plurality of latent image carriers to be transferred to a transfer body one above the other; means for determining the degree of overlap between a first toner image previously transferred to the transfer body and a second toner image to be transferred to the transfer body to generate a determination result; means for controlling the plurality of image forming devices based on the determination result so as to control an amount of toner to be adhered to form the second toner image based on the determination result; and means for controlling a transfer bias for transferring the second toner image to the transfer body based on the determination result.

In another example, the present invention may reside in an image forming apparatus including: a latent image carrier; a plurality of image forming devices to form a plurality of toner images by applying toner to the latent image carrier; transferring means applied with a transfer bias by a power source to cause the plurality of toner images formed on the image carrier to be transferred to a transfer body one above the other; means for determining the degree of overlap between a first toner image previously transferred to the transfer body and a second toner image to be transferred to the transfer body to generate a determination result; means for controlling the plurality of image forming devices based on the determination result so as to control an amount of toner to be adhered to form the second toner image based on the determination result; and means for controlling a transfer bias for transferring the second toner image to the transfer body based on the determination result.

In one example, when the determination result indicates that the first toner image has a portion that is not superimposed by the second toner image, the means for controlling the plurality of image forming devices controls the amount of toner to be adhered to form the second toner image such that toner adhesion at a portion of the transfer body to which the second toner image is transferred is greater than toner adhesion at a portion of the transfer body having no first toner image. Further, the means for controlling a transfer bias controls a transfer bias such that a transfer electric filed generated at a portion of the transfer body to which the second toner image is transferred is less than a transfer electric field generated at a portion of the transfer body having no first toner image.

In one example, the transferring means is applied with a transfer bias controlled by the power source at a fixed current. When the determination result indicates that the first toner image has a portion that is not superimposed by the second toner image, the means for controlling a transfer bias controls a transfer current such that the portion of the transfer body to which the second toner image is transferred is less than the portion of the transfer body having no first toner image.

In one example, when the portion of the transfer body to which the second toner image is transferred has no first toner image in a transfer body width direction, or when the means for determining determines that the second toner image superimposes over an entire surface of the first toner image, the means for controlling a transfer bias controls the power source so as to increase a value of current with the decrease in the printing ratio of the second toner image.

In one example, the transferring means is applied with a transfer bias by the power source controlled at a fixed current. When the means for determining determines that the portion of the first toner image is not superimposed by the second toner image, the means for controlling an amount of toner controls the amount of toner to be adhered to form the second toner image to increase with the decrease in the printing ratio of the second toner image.

In one example, when there is no second toner image to be transferred, the means for controlling a transfer bias controls the transfer bias to have a value such that an electric field that is less than an electric field expected to be generated when there is the second toner image is to be transferred.

In one example, wherein the transferring bias controlling means detects at least one of an electric charge of toner, temperature, humidity, and a transfer speed of the transfer body to output a detection result, and controls the transfer bias based on the detection result.

In one example, the image forming means includes: means for uniformly charging the plurality of image carriers; means for forming a plurality of latent images on the charged image carriers; and means for developing the latent images into toner images by applying a developing bias to a developing agent carrier carrying a developer including at least toner to cause the toner on the developing agent carrier to be transferred to the latent images formed on the image carriers. The means for controlling the amount of toner to be adhered to form the second toner image controls the developing bias.

In one example, the developing means collects residual toner that remains on the surface of the image carrier.

In one example, the present invention may reside in a method of controlling an image forming apparatus including: forming a latent image on an image carrier according to image information; forming a toner image using a developing device that develops the latent image formed on the image carrier into the toner image by applying toner to the latent image formed on the image carrier; providing a transfer device at a location that faces the image carrier via a transfer body to form a transfer nip with the image carrier, the transfer device supplied with a transfer bias to transfer the toner image formed on the image carrier to the transfer body at the transfer nip; determining whether there is a first toner image to be firstly transferred to the transfer body and a second toner image to be subsequently transferred to the transfer body so as to be superimposed on the first toner image; determining whether the first toner image has a portion that is not superimposed by the second toner image when the second toner image is transferred to generate a determination result; and controlling a transfer bias applied to the transfer device that causes the second toner image to be transferred to the transfer body, and an amount of toner to be adhered from the developing device to the image carrier to form the second toner image formed on the image carrier, respectively, based on the determination result.

In one example, the present invention may reside in a recording medium storing a plurality of instructions which cause a processor to perform the above-described method of controlling an image forming apparatus. For example, a controller of an image forming apparatus loads an image forming apparatus control program, which is stored in a recording medium or obtained through a network, onto its local memory to cause the image forming apparatus to function as the printer 100 described above.

As described above, an amount of toner to be adhered from the developing device to the image carrier from the developing device to the image carrier to form the second image and a transfer bias to be applied to transfer the second toner image are respectively controlled based on a determination result indicating whether the first toner image is superimposed by the second toner image over an entire surface. This suppresses the occurrence of reverse transfer, while keeping the amount of toner adhered to the transfer body at a desired level. When a controller determines that there is a portion of the first toner image that is not superimposed by the second toner image, the controller controls the amount of toner to be adhered to form the second toner image such that toner adhesion at a portion of the transfer body to which the second toner image is transferred is greater than toner adhesion at a portion of the transfer body having no first toner image in the transfer body width direction. When the controller determines that there is a portion of the first toner image that is not superimposed by the second toner image, the controller controls the transfer bias to transfer the second toner image such that an electric transfer field generated at the portion of the transfer body to which the second toner image is transferred is less than an electric transfer field generated at the portion of the transfer body having no first toner image in the transfer body width direction. By controlling the transfer bias, a current that flows through between the transfer body and the non-image section of a surface of the image carrier may be suppressed. This prevents a portion of the first toner image that is not superimposed by the second toner image to be charged with a polarity that is opposite to an expected polarity, thus suppressing the occurrence of reverse transfer of toner. Accordingly, a sufficient level of toner remains on the transfer body, thus improving the resultant image quality.

In case of implementing the cleaner-less method, if reverse transfer occurs, toner of a specific color may be collected into a developing unit of a color different from the specific color, thus resulting in mix of toner color. By suppressing the reverse transfer, the problem of toner mix is suppressed such that color reproducibility of an image forming apparatus is kept relatively high for a longer time period.

If the transfer bias is controlled as described above, a transfer rate may be lowered. In view of this, the amount of toner to be adhered to form the second toner image is controlled such that toner adhesion at a portion of the transfer body to which the second toner image is transferred is greater than toner adhesion at a portion of the transfer body having no first toner image in the transfer body width direction. Accordingly, a desired level of toner is adhered onto the transfer body such that degradation in image density is suppressed to improve image quality.

When the controller determines that there is no portion of the first toner image that is not superimposed by the second toner image, the controller controls the amount of toner to be adhered to form the second toner image and the transfer bias that causes the second toner image to be transferred as follows. More specifically, the controller determines that there is no portion of the first toner image that is not superimposed by the second toner image in either of the case in which the portion of the transfer body to which the second toner image is transferred does not have the first toner image in the transfer body width direction or the case in which the second toner image overlaps entirely the first toner image. In either case, toner formed on the transfer body is not most likely to be reverse transferred to the image carrier. Since it is not necessary to lower the electric transfer field, the controller controls a transfer bias so as to obtain a sufficient level of transfer rate. Further, since the transfer rate is kept at a sufficient level, the controller does not have to control the amount of toner to be adhered to form the second toner image to keep a desired level of toner adhesion. For this reason, the controller controls the amount of toner to be adhered to form the second toner image to be less than the amount of toner to be adhered to form the second toner image when there is the portion of the first toner image that is not superimposed by the second toner image, thus suppressing toner consumption.

As described above, in this example, the image forming apparatus is able to suppress degradation in image quality attributable to reverse transfer, while allowing toner to be adhered to the transfer body to have a desired level.

As described above, the printing ratio includes any information that indicates a ratio of a section where printing is performed to a section where printing can be performed.

Accordingly, the printing ratio may be referred to as image information, such as a number of pixels, which indicates a ratio of a section where printing is performed to a section where printing can be performed.

What is claimed is:

1. An image forming apparatus, comprising:

an image carrier to form a latent image thereon according to image information;

an image forming device provided with a developing device that develops the latent image formed on the image carrier into a toner image by applying toner to the latent image formed on the image carrier;

a transfer device provided at a location that faces the image carrier via a transfer body to form a transfer nip with the image carrier and supplied with a transfer bias to transfer the toner image formed on the image carrier to the transfer body at the transfer nip; and a controller device to:

determine whether there is a first toner image to be firstly transferred to the transfer body and a second toner image to be subsequently transferred to the transfer body so as to be superimposed on the first toner image;

determine whether the first toner image has a portion that is not superimposed by the second toner image when the second toner image is transferred to generate a determination result; and control a transfer bias applied to the transfer device that causes the second toner image to be transferred to the transfer body and thereby control an amount of toner to be adhered from the developing device to the image carrier to form the second toner image on the image carrier, respectively, based on the determination result, wherein the controller device controls, according to a determination result indicating that the first toner image has a portion that is not superimposed by the second toner image:

the transfer bias that causes the second toner image to be transferred such that a transfer electric field generated at a portion of the transfer body to which the second toner image is transferred is less than a transfer electric field expected to be generated at the transfer body when no first toner image is formed on the transfer body; and a developing voltage that controls the amount of toner to be adhered from the developing device to the image carrier to form the second toner image such that toner adhesion at the portion of the transfer body to which the second toner image is transferred is greater than toner adhesion expected to be generated at the transfer body when no first toner image is formed on the transfer body.

2. The image forming apparatus of claim 1, further comprising:

a transfer power source coupled to the transfer device to apply a transfer current to the transfer device to control the transfer bias, wherein, according to a determination result indicating that the first toner image has a portion that is not superimposed by the second toner image, the controller device controls the transfer power source to apply the transfer current to the transfer device having a value less than a value of the transfer current expected to be applied to the transfer device when no first toner image is formed on the transfer body.

3. The image forming apparatus of claim 2, wherein, according to a determination result indicating that the first toner image does not have a portion that is not superimposed by the second toner image, the controller device controls the transfer power source to apply a transfer current to the transfer device having a value that increases as a printing ratio of the second toner image decreases.

4. The image forming apparatus of claim 3, wherein, according to a determination result indicating that the first toner image has a portion that is not superimposed by the second toner image, the controller device increases the amount of toner to be adhered to as the printing ratio of the second toner image decreases.

5. The image forming apparatus of claim 4, wherein when the controller device determines that there is no second toner image to be subsequently transferred, the controller controls the transfer bias so as to generate an electric field that is less than an electric field expected to be generated when there is a second toner image to be subsequently transferred.

6. The image forming apparatus of claim 5, wherein the controller device detects at least one of an electric charge of toner, temperature, humidity, and a transfer speed of the transfer body to output a detection result, and controls the transfer bias based on the detection result.

7. The image forming apparatus of claim 6, further comprising:

a developer power source coupled to the developing device to apply the developing voltage to the developing device, wherein the controller device controls the amount of toner to be adhered through the developer power source that is caused to apply the developing voltage having a value determined based on the determination result.

8. The image forming apparatus of claim 1, wherein the developing device collects residual toner that resides on the image carrier after the second toner image is transferred, and stores the collected toner in the developing device for later use.

9. An image forming apparatus, comprising:

means for forming a latent image on an image carrier according to image information;

means for developing the latent image formed on the image carrier into a toner image by applying toner to the latent image formed on the image carrier;

means for forming a transfer nip with the image carrier applied with a transfer bias to transfer the toner image formed on the image carrier to the transfer body at the transfer nip;

means for determining whether there is a first toner image to be firstly transferred to the transfer body and a second toner image to be subsequently transferred to the transfer body so as to be superimposed on the first toner image;

means for determining whether the first toner image has a portion that is not superimposed by the second toner image when the second toner image is transferred to generate a determination result;

means for controlling a transfer bias applied to the means for forming a transfer nip that causes the second toner image to be transferred to the transfer body based on the determination result; and means for controlling an amount of toner to be adhered from the means for developing to the image carrier to form the second toner image formed on the image carrier based on the determination result, wherein the means for controlling controls, according to a determination result indicating that the first toner image has a portion that is not superimposed by the second toner image:

the transfer bias that causes the second toner image to be transferred such that a transfer electric field generated at a portion of the transfer body to which the second toner image is transferred is less than a transfer electric field expected to be generated at the transfer body when no first toner image is formed on the transfer body; and a developing voltage that controls the amount of toner to be adhered from the means for developing to the image carrier to form the second toner image such that toner adhesion at the portion of the transfer body to which the second toner image is transferred is greater than toner adhesion expected to be generated at the transfer body when no first toner image is formed on the transfer body.

10. A method of controlling an image forming apparatus, comprising:

forming a latent image on an image carrier according to image information;

forming a toner image using a developing device that develops the latent image formed on the image carrier into the toner image by applying toner to the latent image formed on the image carrier;

providing a transfer device at a location that faces the image carrier via a transfer body to form a transfer nip with the image carrier, the transfer device supplied with a transfer bias to transfer the toner image formed on the image carrier to the transfer body at the transfer nip;

determining whether there is a first toner image to be firstly transferred to the transfer body and a second toner image to be subsequently transferred to the transfer body so as to be superimposed on the first toner image;

determining whether the first toner image has a portion that is not superimposed by the second toner image when the second toner image is transferred to generate a determination result; and controlling a transfer bias applied to the transfer device that causes the second toner image to be transferred to the transfer body and thereby control an amount of toner to be adhered from the developing device to the image carrier to form the second toner image formed on the image carrier, respectively, based on the determination result, wherein the controlling comprises:

controlling the transfer bias that causes the second toner image to be transferred such that a transfer electric field generated at a portion of the transfer body to which the second toner image is transferred is less than a transfer electric field expected to be generated at the transfer body when no first toner image is formed according to a determination result indicating that the first toner image has a portion that is not superimposed by the second toner image; and controlling a developing voltage that controls the amount of toner to be adhered to form the second toner image such that toner adhesion at the portion of the transfer body to which the second toner image is transferred is greater than toner adhesion expected to be generated at the transfer body when no first toner image is formed according to a determination result indicating that the first toner image has a portion that is not superimposed by the second toner image.

11. The method of claim 10, wherein the controlling the transfer bias comprises:

controlling a transfer power source coupled to the transfer device to cause the transfer power source to apply a transfer current having a value that increases as a printing ratio of the second toner image decreases according to a determination result indicating that the second toner image does not have a portion that is not superimposed by the first toner image.

12. The method of claim 11, wherein the controlling the amount of toner comprises:

increasing the amount of toner to be adhered to as the printing ratio of the second toner image decreases according to a determination result indicating that the first toner image has a portion that is not superimposed by the second toner image.

13. The method of claim 12, further comprising:

determining whether there is a second toner image to be subsequently transferred; and when it is determined that there is no second toner image to be subsequently transferred, controlling the transfer bias so as to generate an electric field that is less that is than an electric field expected to be generated when there is a second toner image to be subsequently transferred.

* * * * *